US011589673B1

(12) United States Patent
Moore

(10) Patent No.: US 11,589,673 B1
(45) Date of Patent: Feb. 28, 2023

(54) DESK WITH SUPPORT STRUCTURES CONFIGURED TO ATTACH MODULAR ATTACHMENTS

(71) Applicant: Mateo Goods Co., Tempe, AZ (US)

(72) Inventor: Matthew Jason Moore, Phoenix, AZ (US)

(73) Assignee: Mateo Goods Co., Tempe, AZ (US)

( * ) Notice: Subject to any disclaimer, the term of this patent is extended or adjusted under 35 U.S.C. 154(b) by 0 days.

(21) Appl. No.: 17/504,274

(22) Filed: Oct. 18, 2021

Related U.S. Application Data

(60) Provisional application No. 63/129,297, filed on Dec. 22, 2020.

(51) Int. Cl.
*A47B 9/20* (2006.01)
*A47B 21/04* (2006.01)
*A47B 21/02* (2006.01)

(52) U.S. Cl.
CPC ..... *A47B 9/20* (2013.01); *A47B 21/02* (2013.01); *A47B 21/04* (2013.01); *A47B 2200/0058* (2013.01); *A47B 2200/0062* (2013.01); *A47B 2200/0084* (2013.01)

(58) Field of Classification Search
CPC ..... A47B 9/20; A47B 21/02; A47B 21/04; A47B 2200/0058; A47B 2200/0062; A47B 2200/0084
USPC ..... 108/180, 50.01, 157.14
See application file for complete search history.

(56) References Cited

U.S. PATENT DOCUMENTS

| | | | | |
|---|---|---|---|---|
| D128,791 | S | 8/1941 | Ullery | |
| 2,560,957 | A * | 7/1951 | Johnson | A47B 47/042 211/186 |
| D164,584 | S | 9/1951 | Koegel | |
| 2,636,224 | A | 4/1953 | Murdoch | |
| 3,113,531 | A | 12/1963 | Barnard | |
| D208,256 | S | 8/1967 | Rich | |
| D216,204 | S | 12/1969 | Hess | |
| D243,192 | S | 1/1977 | Clayton | |
| D243,300 | S | 2/1977 | Christensen | |

(Continued)

FOREIGN PATENT DOCUMENTS

| | | |
|---|---|---|
| CA | 2348060 | 11/2002 |
| CA | 2840843 | 12/2013 |

(Continued)

OTHER PUBLICATIONS

The Sit Desk by Mateo Goods, first available: Unknown, hellomateogoods.com [online], [site visited Apr. 13, 2022], Internet URL: https://hellomateogoods.com/collections/all/products/the-static-desk (Year: 2022).

(Continued)

*Primary Examiner* — Jose V Chen
(74) *Attorney, Agent, or Firm* — Esplin & Associates, PC

(57) ABSTRACT

A desk with support structures configured to attach modular attachments is disclosed. Exemplary implementations may include a work surface, a left-side support structure, a right-side support structure, a core body, a working body that provides the work surface, one or more modular attachments, one or more mounting brackets, and/or other components. The one or more modular attachments can be mechanically coupled to and supported by either support structure.

12 Claims, 18 Drawing Sheets

(56) References Cited

U.S. PATENT DOCUMENTS

D260,716 S 9/1981 Cohen
D261,713 S 11/1981 Curatolo
D262,763 S 1/1982 Lerner
D262,846 S 2/1982 Chaiken
D267,690 S 1/1983 Verdesca
D278,583 S 4/1985 Koguma
D285,394 S 9/1986 Curran
D286,832 S 11/1986 Matthews
4,651,652 A 3/1987 Wyckoff
4,668,026 A 5/1987 Lapeyre
D297,987 S 10/1988 Borsos
4,790,611 A 12/1988 Craner
D305,585 S 1/1990 Wright
D305,838 S 2/1990 Bienenstock
4,969,403 A 11/1990 Schwartz
4,987,835 A 1/1991 Schwartz
D314,289 S 2/1991 Schaelling
5,083,514 A 1/1992 Schwartz
D330,469 S 10/1992 Brodbeck
D340,816 S 11/1993 Lee
D345,062 S 3/1994 Brandon
5,322,025 A * 6/1994 Sherman ..... A47B 9/10 108/147
5,363,775 A * 11/1994 Simpson ..... A47B 47/042 108/157.13
D368,812 S 4/1996 Lee
5,544,593 A 8/1996 Canfield
5,720,185 A 2/1998 Lee
D393,958 S 5/1998 Moncourtois
5,791,265 A * 8/1998 Ellsworth ..... A47B 47/00 312/265.4
6,070,956 A 6/2000 Yates
D441,566 S 5/2001 Martin
6,286,441 B1 * 9/2001 Burdi ..... A47B 9/00 108/147
6,398,326 B1 * 6/2002 Wang ..... A47B 21/00 108/50.01
6,708,627 B1 3/2004 Wood
D489,200 S 5/2004 Antonioni
D496,183 S 9/2004 Savage
6,796,247 B1 * 9/2004 Iglseder ..... G06K 7/10336 108/50.01
D516,340 S 3/2006 Chang
D546,103 S 7/2007 Eyman
D552,900 S 10/2007 Wilenius
7,331,296 B1 2/2008 Wood
7,398,738 B2 7/2008 Newhouse
D596,876 S 7/2009 Oshinomi
D610,840 S 3/2010 Kato
7,789,251 B1 * 9/2010 Clark ..... A47B 57/12 211/186
7,866,622 B2 1/2011 Dittmer
7,975,626 B1 * 7/2011 Wang ..... A47B 3/002 108/50.01
D647,324 S 10/2011 Kincaid
D653,862 S 2/2012 Hairston
D677,943 S 3/2013 Mendoza
D724,364 S 3/2015 Demars
8,985,032 B1 3/2015 Johnson
D730,658 S 6/2015 Dillon
9,277,806 B2 3/2016 Hallman
D761,577 S 7/2016 Agati
D773,219 S 12/2016 Clouse
9,593,481 B2 3/2017 Gosling
D788,496 S 6/2017 Yamamoto
9,723,919 B1 8/2017 Randolph
9,980,559 B2 5/2018 Randolph
10,034,538 B1 7/2018 Masters
D853,759 S 7/2019 Moore
D863,833 S 10/2019 Moore
10,561,233 B1 2/2020 Lin
10,939,752 B2 3/2021 Moore
2002/0050234 A1 * 5/2002 Lechman ..... A47B 21/007 108/50.01
2004/0123782 A1 * 7/2004 Korber ..... A47B 21/0073 108/50.01
2004/0173125 A1 * 9/2004 Chang ..... A47B 21/03 108/50.01
2004/0237852 A1 * 12/2004 Tsai ..... A47B 21/03 108/50.01
2005/0016080 A1 1/2005 Williams
2006/0185564 A1 8/2006 Stengel
2006/0230992 A1 * 10/2006 Newhouse ..... A47B 9/18 108/147
2007/0044692 A1 * 3/2007 Zimmer ..... A47B 47/04 108/180
2008/0018211 A1 1/2008 Dye
2008/0284292 A1 11/2008 Castelluccio
2008/0284293 A1 11/2008 Martin
2009/0094913 A1 4/2009 Singh
2016/0128469 A1 5/2016 Matthai
2016/0260019 A1 * 9/2016 Riquelme Ruiz ..... G06N 20/00
2016/0353876 A1 12/2016 Mitchell
2016/0360879 A1 * 12/2016 Kelley ..... A47B 21/06
2017/0251806 A1 * 9/2017 Newman ..... A47B 21/02
2018/0168334 A1 6/2018 Swartz
2018/0360207 A1 * 12/2018 Neudeck ..... A47B 9/00
2019/0023298 A1 * 1/2019 Carzola ..... B62B 5/00
2019/0125075 A1 * 5/2019 Soulliere ..... A47B 96/206
2019/0223586 A1 * 7/2019 Hansen ..... A47C 3/20
2019/0374023 A1 * 12/2019 Allen ..... A47B 9/20
2020/0178683 A1 * 6/2020 O'Gara ..... A47B 9/18
2020/0329860 A1 * 10/2020 Xiang ..... F16P 3/144
2020/0329861 A1 * 10/2020 Zhang ..... A47C 7/72
2021/0011453 A1 * 1/2021 Xiang ..... G05B 19/402
2022/0031062 A1 * 2/2022 Albert ..... A47B 9/20
2022/0218102 A1 * 7/2022 Isgar ..... A47B 21/02
2022/0273094 A1 9/2022 Wallis

FOREIGN PATENT DOCUMENTS

GB 2362822 12/2001
WO 2016195853 12/2016

OTHER PUBLICATIONS

All Sit / Sitstand Desks by Mateo Goods, first available: Unknown, hellomateogoods.com [online], [site visited Apr. 13, 2022], Internet URL: https://hellomateogoods.com/collections/all (Year: 2022).
The Sit-Stand Desk by Mateo Goods, first available: Sep. 26, 2020. Indiegogo.com [online], [site visited Apr. 13, 2022], Internet URL:https://www.indiegogo.com/projects/the-sit-stand-desk-by-mateo#/ (Year:: 2020).

* cited by examiner

DESK WITH SUPPORT STRUCTURES CONFIGURED TO ATTACH MODULAR ATTACHMENTS

FIELD OF THE DISCLOSURE

The present disclosure relates to a desk with support structures configured for modular attachments.

BACKGROUND

Desks are known, typically as work surfaces for people at a fixed height. Height-adjustable desks are known, typically the legs on the left side and right side provide the lifting mechanisms used to lower and raise some part of the desks.

SUMMARY

One aspect of the present disclosure relates to a desk with support structures configured to attach one or more modular attachments. In some cases, the desk may be configured to be positioned for a person (i.e., a user) in a sitting and/or standing position. As used herein, relative positional terms including but not limited to rear side, front side, left side and right side may refer to the point of view of a user positioned at the desk in a common fashion. The desk may include one or more of a work surface, a left-side support structure, a right-side support structure, a core body, a working body that provides the work surface, one or more modular attachments, one or more mounting brackets, and/or other components. Some components of the desk, including the one or more modular attachments, may have no direct contact with the ground and may be supported by one or more support structures. As described by the present disclosure, the desk may provide different improvements and/or advantages, including but not limited to a flexible and adjustable configuration of different components.

As used herein, any association (or relation, or reflection, or indication, or correspondency) involving desk parts, surfaces, support structures, bodies, attachments, openings, cavities, stiles, actuators, motors, columns, arms, housings, couplings, interfaces, buttons, and/or another entity or object that interacts with any part of the desk, may be a one-to-one association, a one-to-many association, a many-to-one association, and/or many-to-many association or "N"-to-"M" association (note that "N" and "M" may be different numbers greater than 1).

As used herein, the term "detect" (and derivatives thereof) may include active determination, realization, and conclusion of user input, and/or any combination thereof. As used herein, the term "control" (and derivatives thereof) may include active and/or passive effectuation, and causation of a response to user input, and/or any combination thereof. As used herein, the term "adjustably coupled" (and derivatives thereof) may include temporary and/or permanent fastening, joining, assembling, combining, and/or uniting of desk parts, and/or any combination thereof.

These and other features and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1A:
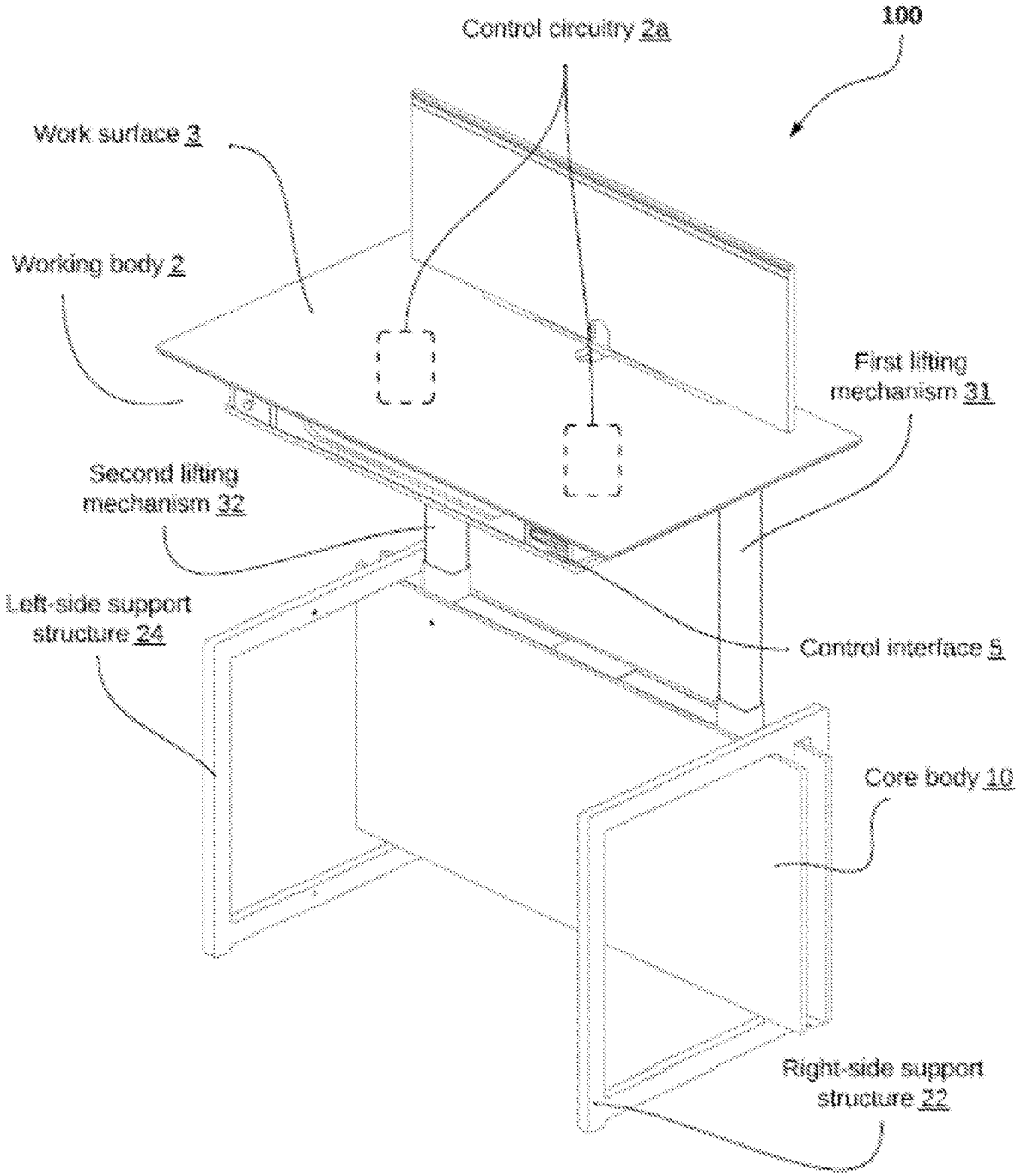
FIG. 1A shows an assembled view of a height-adjustable desk in its lifted position, in accordance with one or more implementations.
Figure 6:
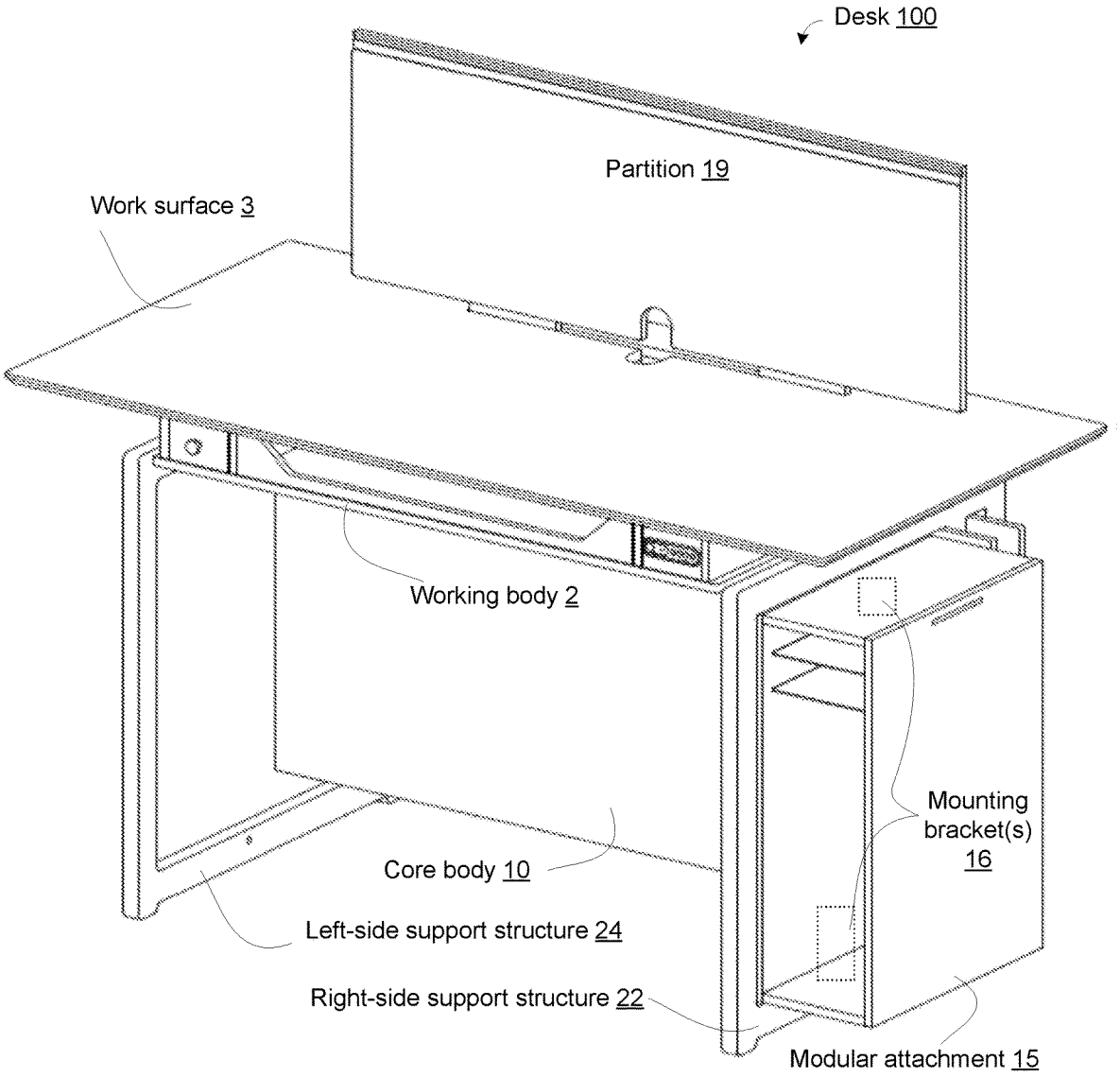
FIG. 6 shows an assembled view of a desk with support structures configured to attach modular attachments, in accordance with one or more implementations.

FIG. 1A shows a desk 100 with support structures (i.e., a left-side support structure 24 on the left side of desk 100 and a right-side support structure 22 on the right side of desk 100 as viewed by a user and as depicted in FIG. 1A) configured to attach and support modular attachments, in accordance with one or more implementations. In some implementations, support structures may be referred to as "legs". The modular attachments can be attached on either the left side or the right side of desk 100, or on both sides at the same time. In some implementations, modular attachments may be attached either outside the support structures, between the support structures, or both. While attached, in some implementations, the modular attachments may be supported (in part, or entirely) by the support structures. By way of non-limiting example, FIG. 6 shows desk 100 and attached to desk 100, a modular attachment 15. Modular attachment 15 may be configured to provide extended functionality to the user of desk 100, as described in this disclosure.

Referring to FIG. 1, in some implementations, desk 100 may be configured to be positioned for a user in a sitting position and/or standing position. FIG. 1A shows desk 100 in a standing and/or lifted position. Desk 100 may include one or more of a working body 2, a control circuitry 2*a*, a work surface 3, a control interface 5, a core body 10, left-side support structure 24, right-side support structure 22, a first lifting mechanism 31, a second lifting mechanism 32, and/or other components. Desk 100 may further include one or more modular attachments 15 (e.g., see FIG. 6 and FIG. 8), one or more mounting brackets 16 (e.g., see FIG. 6 and FIG. 8, these are depicted as dotted rectangles to indicate these components may be embedded within desk 100, and/or otherwise not readily visible from a particular viewing angle), and/or other components.

Left-side support structure 24 and right-side support structure 22 may be configured to be coupled to core body 10 to provide the entire desk stability while being raised, lowered, and/or in use. First lifting mechanism 31 and second lifting mechanism 32 may be coupled to core body 10 and working body 2. By way of non-limiting example, other components may be configured for the desk as there may be preferences by users to customize the desk to their likings.

Figure 1B:
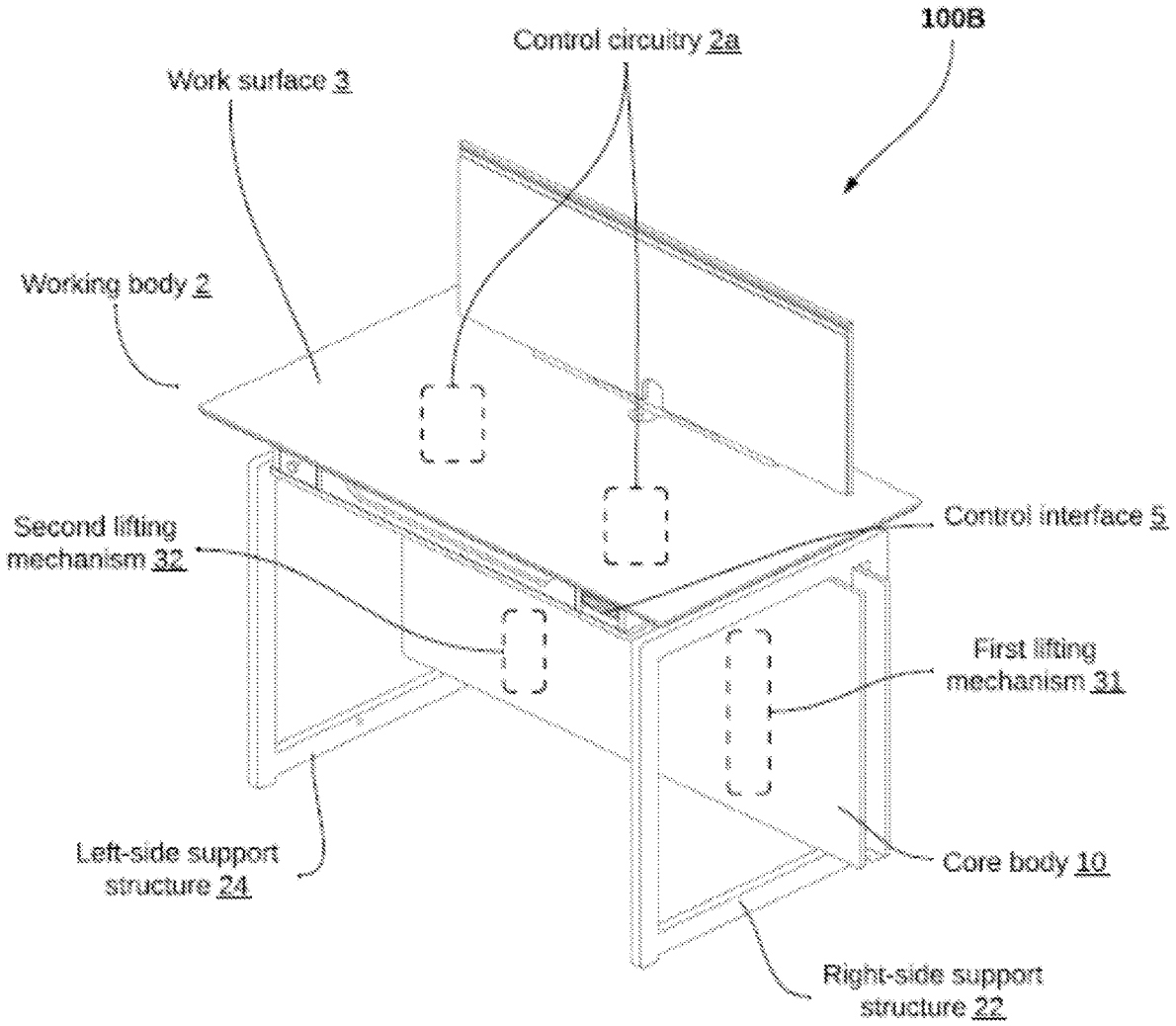
FIG. 1B shows an assembled view of a height-adjustable desk in its lowered position, in accordance with one or more implementations.

FIG. 1B shows an isometric elevated view 100B of a height-adjustable desk in a sitting and/or lowered position. In this position, first lifting mechanism 31 and second lifting mechanism 32 may be (at least partially) housed within core body 10. In some implementations, in this position, first lifting mechanism 31 and second lifting mechanism 32 may be mostly hidden from view.

Figure 1C:
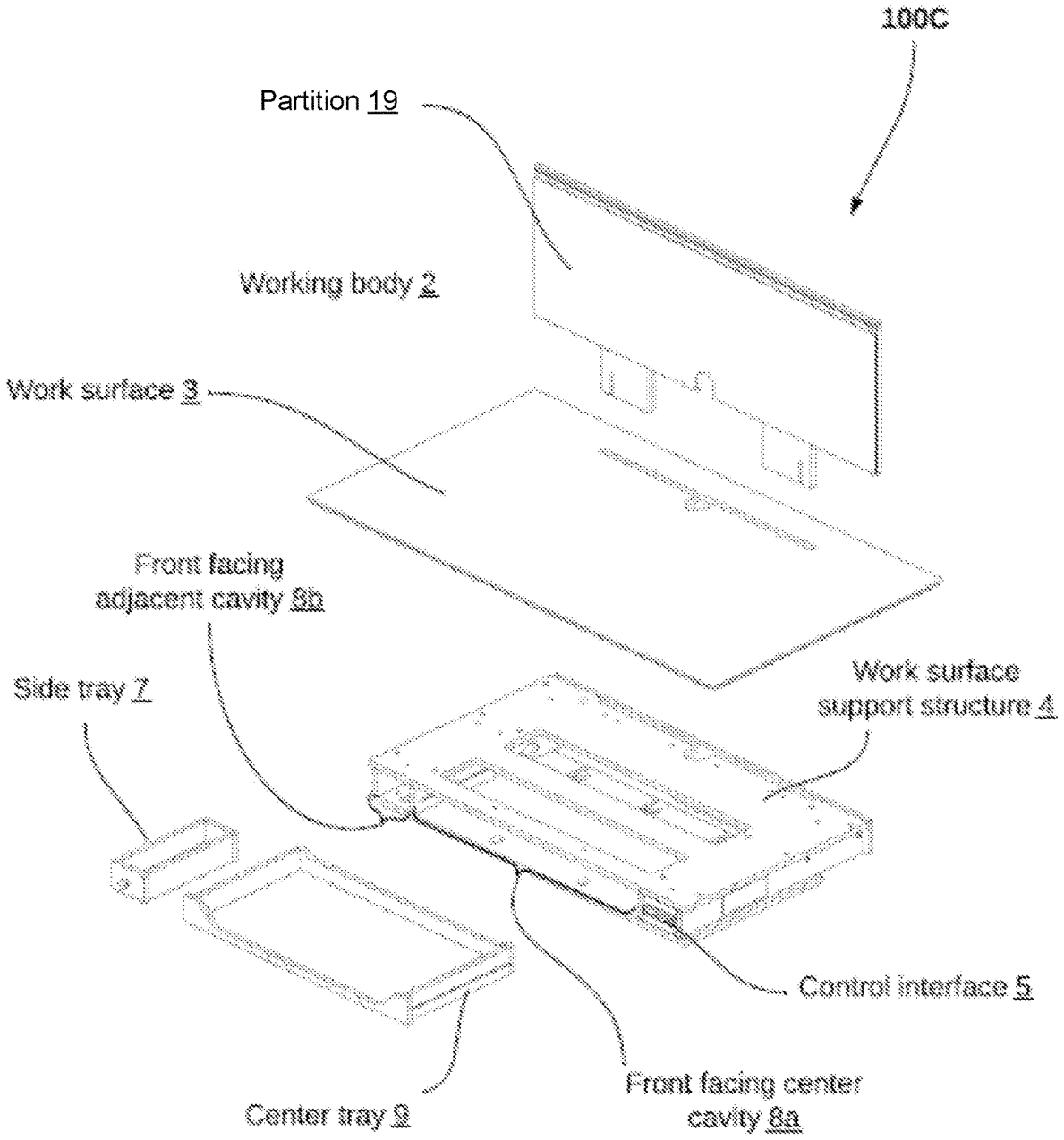
FIG. 1C shows a disassembled and/or exploded view of a working body of a desk, in accordance with one or more implementations.

Working body 2 may be configured to include a work surface 3 coupled to a work surface support structure 4 as shown in FIG. 1C, as well as a partition 19 coupled to work surface 3 as depicted. Working body 2 may be configured to adjustably couple to first lifting mechanism 31 (FIG. 1A) and second lifting mechanism 32 (FIG. 1A). Working body 2 may be configured to be supported by core body 10 at a rear side of desk 100 by virtue of core body 10 being coupled to first lifting mechanism 31 (FIG. 1A), second lifting mechanism 32 (FIG. 1A), right-side support structure 22 (FIG. 1A), and left-side support structure 24 (FIG. 1A).

Work surface 3 of desk 100 may be disposed at a current height. The current height may be adjustable. In some implementations, the adjustments in the current height of work surface 3 may have a vertical range of about 20 inches. In some implementations, the adjustments in the current height of work surface 3 may have a vertical range between about 15 inches and 25 inches. In some implementations, the adjustments in the current height of work surface 3 may have a vertical range between about 18 inches and 24 inches. In some implementations work surface 3 of working body 2 may have a surface area ranging from 46 inches to 52 inches in width. In some implementations work surface 3 of working body 2 may have a surface area of about 26 inches deep. In some implementations work surface 3 of working body 2 may have a surface area ranging between about 22 and about 30 inches deep.

By way of non-limiting example, FIG. 1C shows a work surface support structure 4 which may include a control interface 5, a front facing center cavity 8*a*, a front facing adjacent cavity 8*b*, and/or other components. In some implementations, control interface 5 may be configured to receive user input from the user. The location of control interface 5 on the desk is not limited by its exemplary illustration in FIG. 1C, which is merely meant to represent a convenient position for users to engage with control interface 5 to adjust the current height of work surface 3. By way of non-limiting example, control interface 5 may have one or more buttons to adjust the current height of work surface 3. For example, control interface 5 as shown in the front view 200C (FIG. 2C) of working body 2 may have one or more of a lift button, a lower button, a lock/un-lock button, a memory button designating a user's preferred current height, and/or one or more other buttons used to control, adjust, and/or otherwise operate the current height of work surface 3.

In some implementations, the one or more cavities of work surface support structure 4 of working body 2 may be referred to as openings, orifices, chambers, cutouts, mortices, voids, vacant volumes, and/or other terminology to indicate useable spaces within work surface support structure 4. In some implementations, front facing center cavity 8*a* may contain a center tray 9. By way of non-limiting example, center tray 9 may be inserted and/or withdrawn from front facing center cavity 8*a*. In some implementations, front facing adjacent cavity 8*b* may contain a side tray 7. By way of non-limiting example, side tray 7 may be inserted and/or withdrawn from front facing adjacent cavity 8*b*. In some implementations, the cavities of work surface support structure 4 may contain other desk attachments and/or components other than trays. By way of non-limiting example, the cavities may include storage areas, keyboard and mouse housing, open-faced cavities, and/or other cavity functions.

Figure 2A:
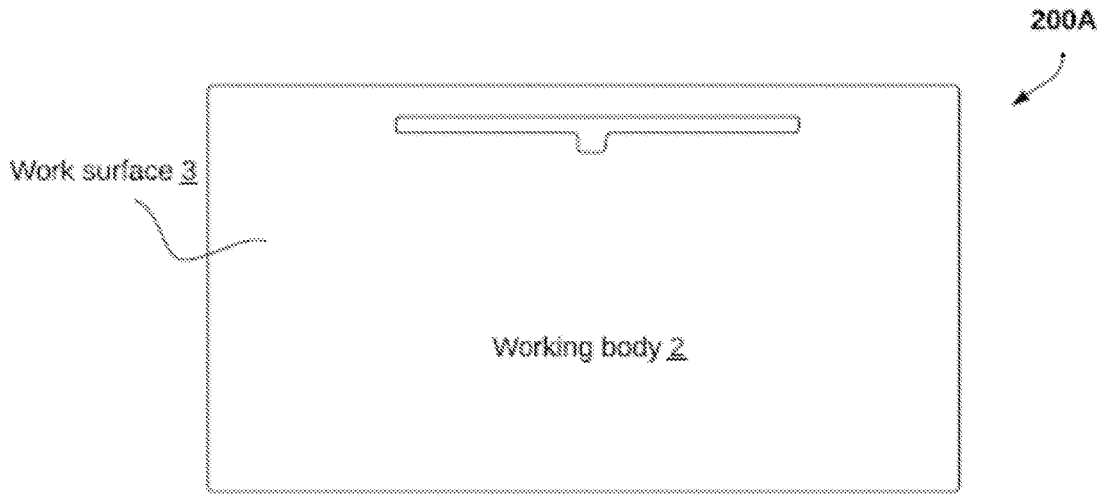
FIG. 2A shows a top view 200A of a working body, in accordance with one or more implementations.
Figure 2B:
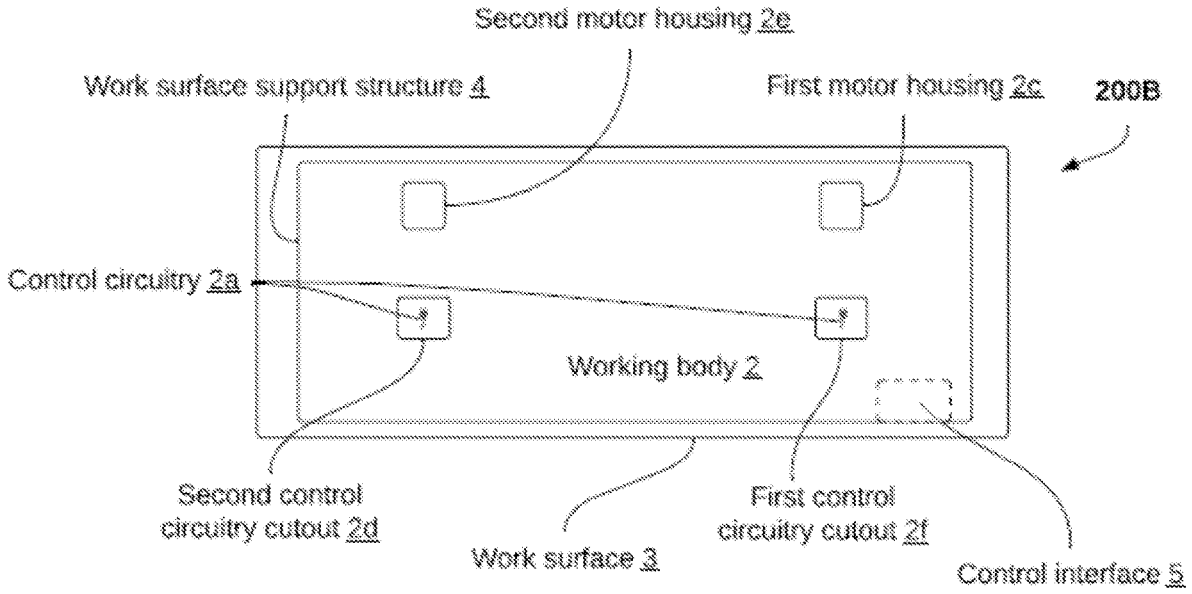
FIG. 2B shows a bottom view 200B of a working body, in accordance with one or more implementations.
Figure 2C:
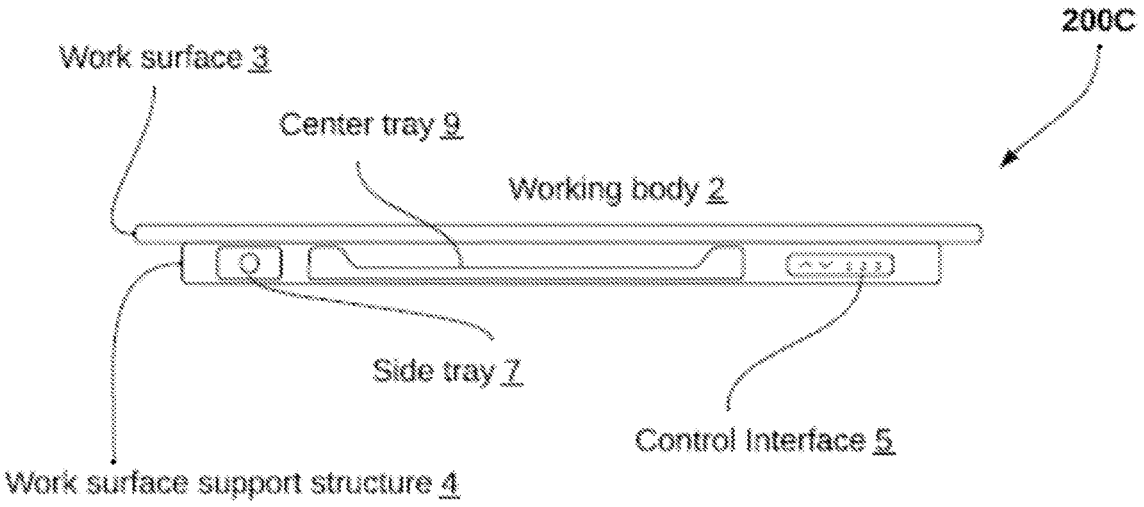
FIG. 2C shows a front view 200C of a working body, in accordance with one or more implementations.

FIG. 2A shows a top view 200A of a working body 2. By way of non-limiting example, FIG. 2B shows a bottom view 200B of working body 2. In some implementations, working body 2 may include a first motor housing 2*c* positioned at the rear of work surface support structure 4. In some implementations, working body 2 may include a second motor housing 2*e*, positioned opposite of first motor housing 2*c* and at the rear of work surface support structure 4.

Referring to bottom view 200B of FIG. 2B, working body 2 may include a control circuitry 2*a*, a first control circuitry cutout 2*f*, a second control circuitry cutout 2*d*, and/or other components. In some implementations, control circuitry 2*a* may be configured to detect user input received by control interface 5. Responsive to the detection of the user input, first lifting mechanism 31 may be controlled to either lift working body 2 and increase the current height of work surface 3 or lower working body 2 and decrease the current height of work surface 3. Responsive to the detection of the user input, second lifting mechanisms 32 may be controlled to either lift working body 2 and increase the current height of work surface 3 or lower working body 2 and decrease the current height of work surface 3, e.g., in synchrony with lifting mechanism 31.

Figure 1D:
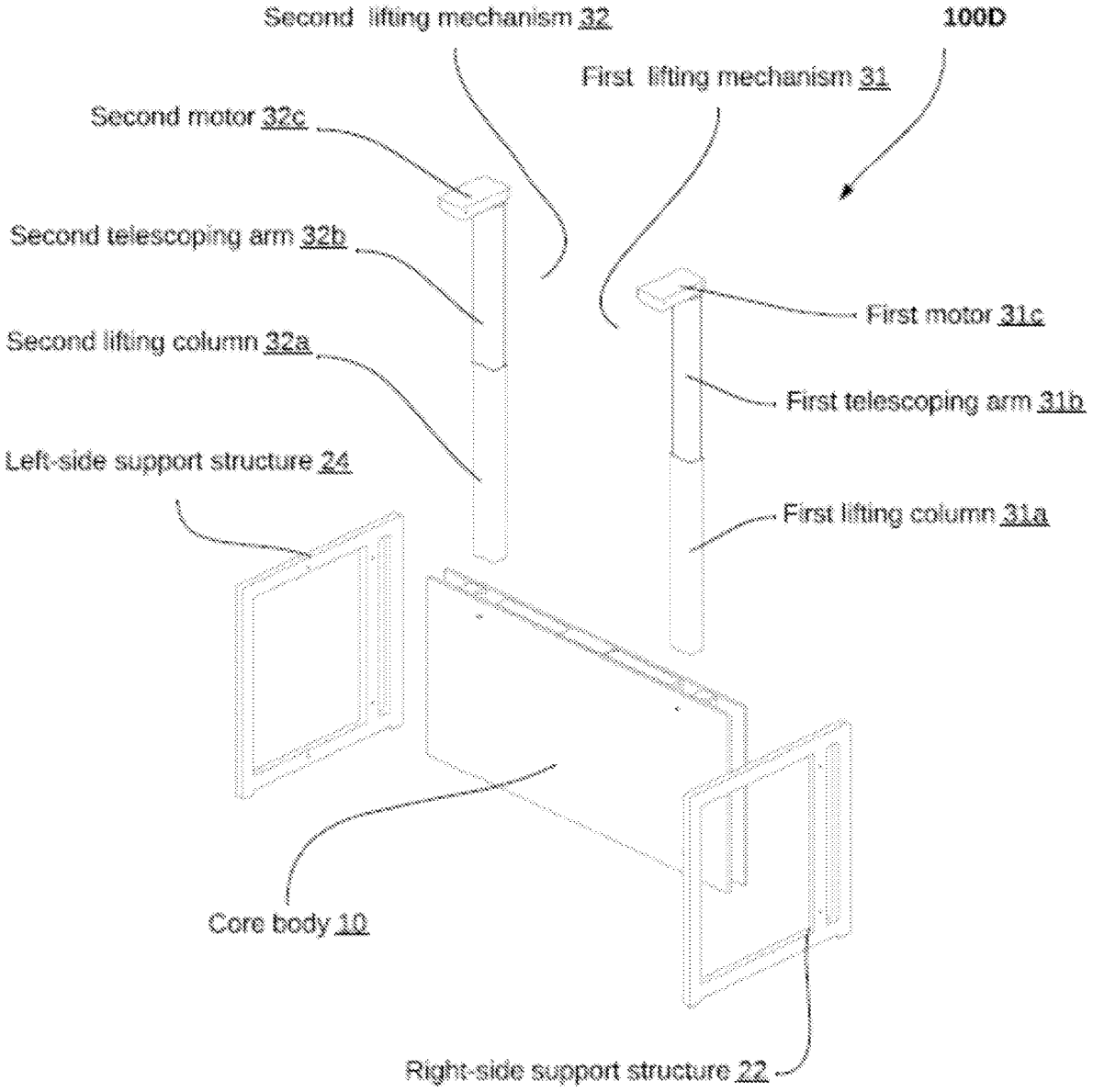
FIG. 1D shows a disassembled and/or exploded view of a core body, a first lifting mechanism, a second lifting mechanism, a left-side support structure, and a right-side support structure, in accordance with one or more implementations.

In some implementations, first control circuitry cutout 2*f* (e.g., orifice, chamber, opening, mortice, void, vacant volume) may be configured to allow users to easily access and connect control circuitry 2*a* to first lifting mechanism 31 (FIG. 1A) when first lifting mechanism 31 (FIG. 1A) is adjustably coupled to working body 2. In some implementations, second control circuitry cutout 2*d* (e.g., orifice, chamber, opening, mortice, void, vacant volume) may be configured to allow users to easily access and connect control circuitry 2*a* to second lifting mechanism 32 (FIG. 1A) when second lifting mechanism 32 (FIG. 1A) is adjustably coupled to working body 2. In some implementations, first motor housing 2*c* may be coupled to a first motor 31*c* (FIG. 1D) of first lifting mechanism 31 (FIG. 1D). Second motor housing 2*e* may be coupled to a second motor 32*c* (FIG. 1D) of second lifting mechanism 32 (FIG. 1D).

Figure 2D:
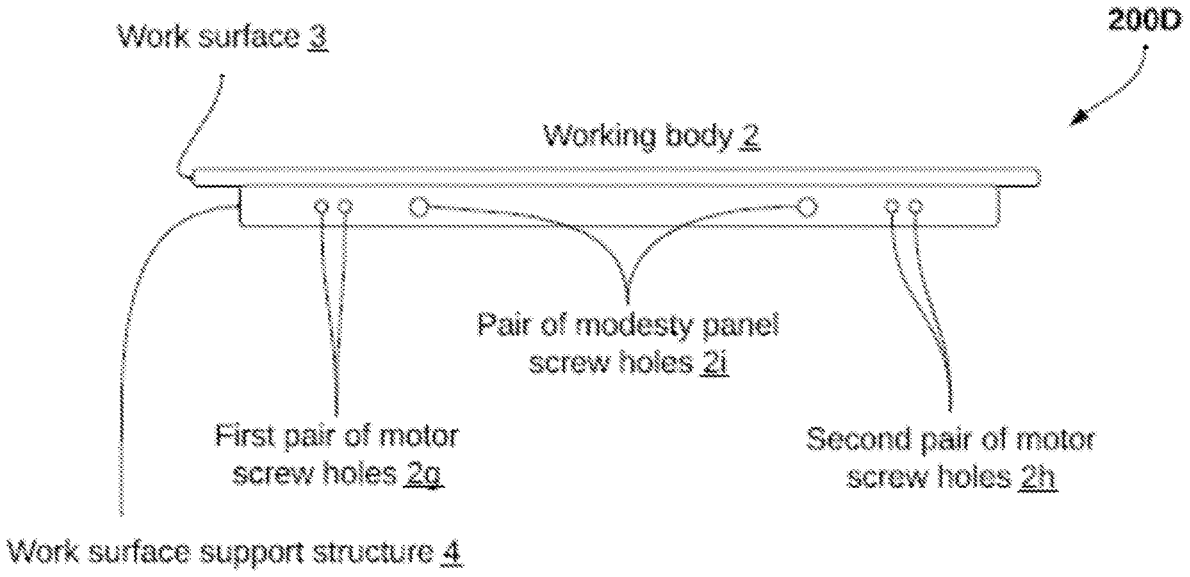
FIG. 2D shows a rear view 200D of a working body, in accordance with one or more implementations.

Referring to FIG. 2D, a rear view 200D of working body 2 shows a first pair of motor screw holes 2*g*, a second pair of motor screw holes 2*h*, a pair of modesty panel screw holes 2*i*, and/or other components. First pair of motor screw holes 2*g* may be configured to include one or more screws, nuts, bolts, pins, and/or one or more other fastening hardware or fasteners to secure/fasten first motor 31*c* (FIG. 1D) of first lifting mechanism 31 (FIG. 1D) to first motor housing 2*c* (FIG. 2B) of working body 2. Second pair of motor screw holes 2*h* may be configured to include one or more of screws, nuts, bolts, pins, and/or one or more other fastening hardware or fasteners to secure/fasten second motor 32*c* (FIG. 1D) of second lifting mechanism 32 (FIG. 1D) to second motor housing 2*e* (FIG. 2B) of working body 2.

Core body 10 may be disposed vertically at a rear side of desk 100 with respect to work surface 3 of desk 100. Core body 10 may extend laterally between the left side and the right side of the desk. Core body 10 may be coupled to left-side support structure 24 (FIG. 1A), right-side support structure 22 (FIG. 1A), and/or other components. In some implementations, core body 10 may house first lifting mechanism 31 (FIG. 1A) and second lifting mechanism 32 (FIG. 1A). In some implementations, core body 10 (apart from first lifting mechanism 31 and second lifting mechanism 32) may be stationary relative to first lifting mechanism 31 and second lifting mechanism 32 during adjustments of the current height of the work surface 3.

Figure 1E:
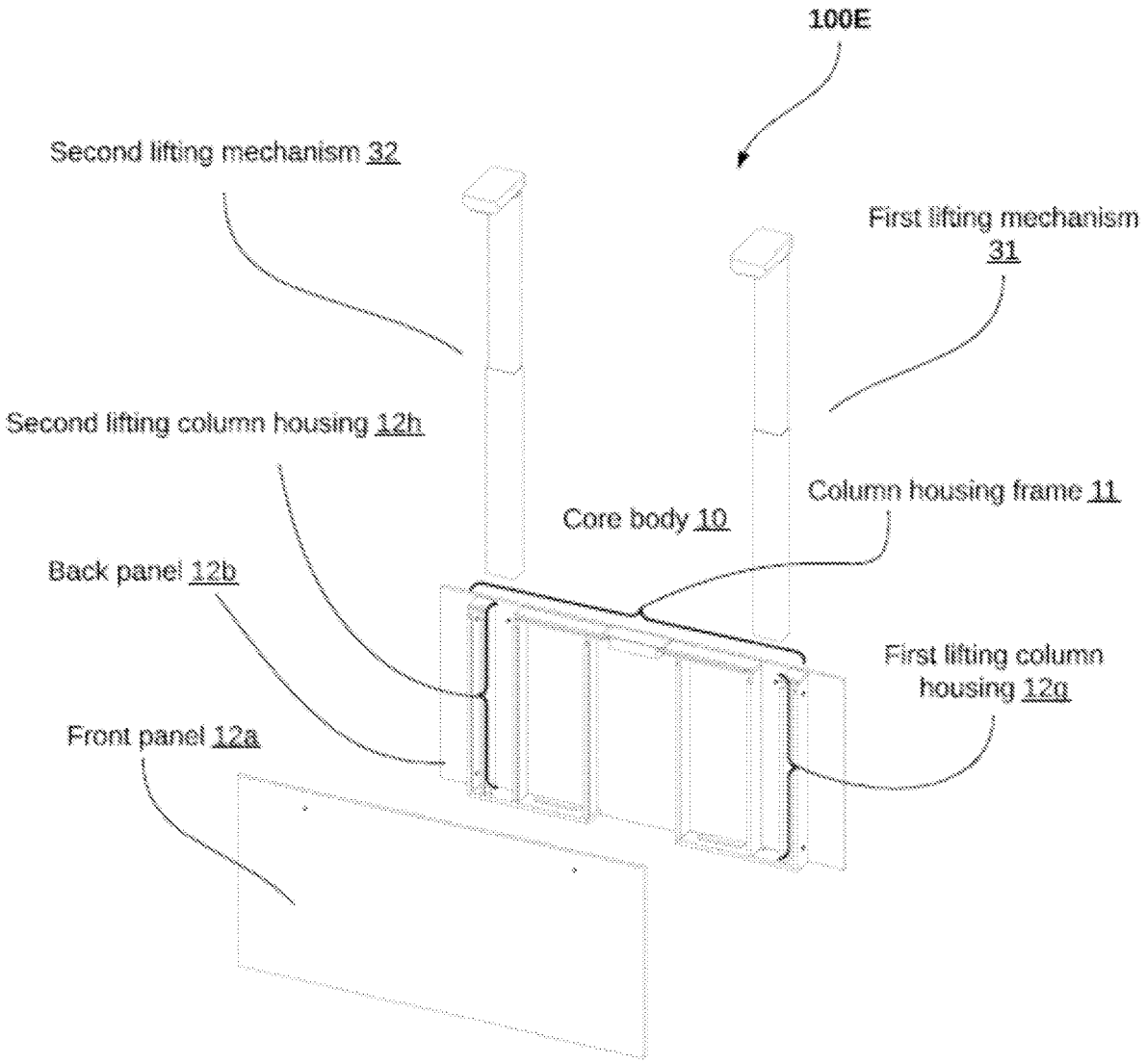
FIG. 1E shows a disassembled and/or exploded view of a core body, a first lifting mechanism, and a second lifting mechanism, in accordance with one or more implementations.

Referring to the core body exploded view 100E of FIG. 1E and by way of non-limiting example, core body 10 may be configured to include one or more of a column housing frame 11, a front panel 12*a*, a back panel 12*b*, a first lifting column housing 12*g*, a second lifting column housing 12*h*, and/or one or more other components. In some implementations, column housing frame 11 may have a front face, a rear face, a left face, and a right face. Column housing frame 11 may be configured to house first lifting column 31*a* and second lifting column 32*a*.

Figure 3A:
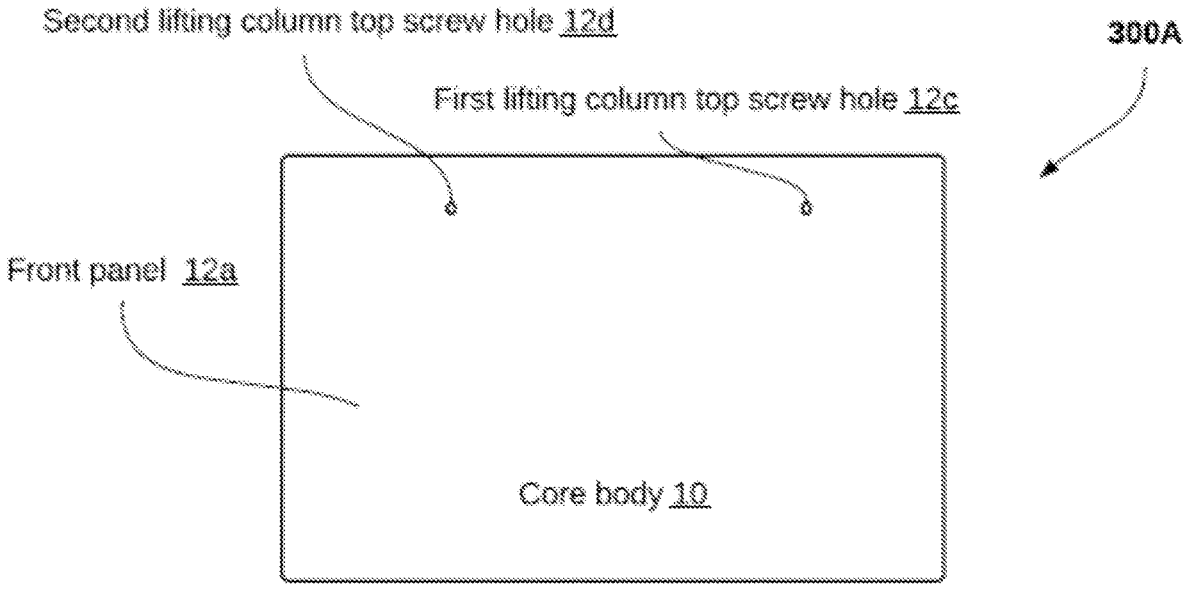
FIG. 3A shows a front view 300A of a core body, in accordance with one or more implementations.
Figure 3B:
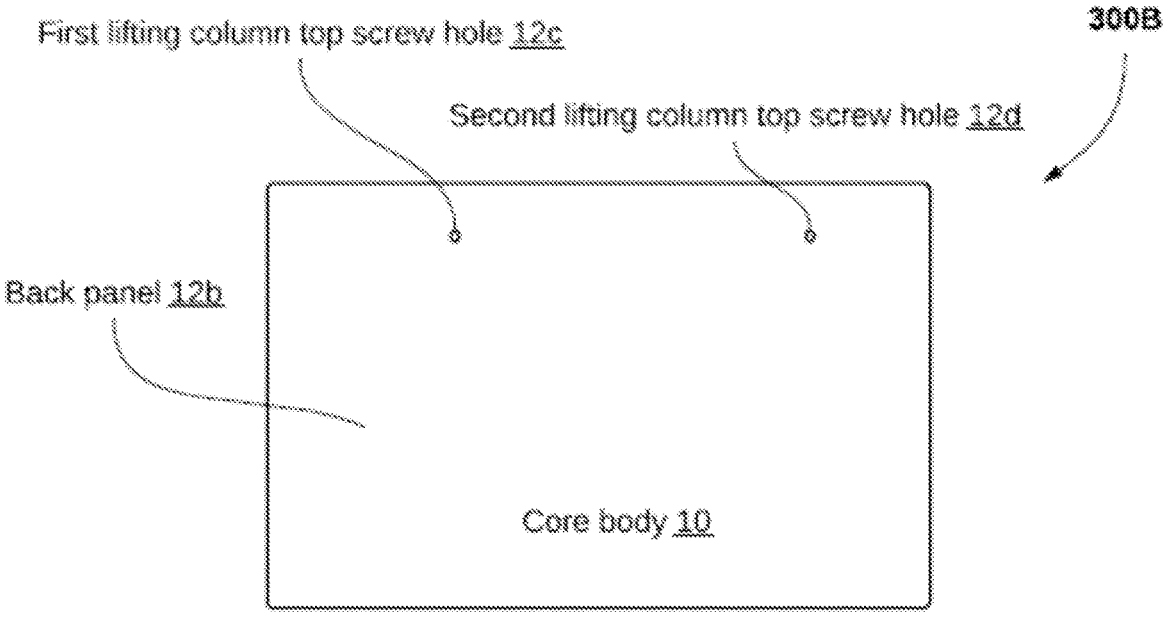
FIG. 3B shows a rear view 300B of a core body, in accordance with one or more implementations.

FIG. 3A shows a core body front view 300A. FIG. 3B shows a core body rear view 300B. In some implementations, front panel 12*a* (see FIG. 3A) and back panel 12*b* (see FIG. 3B) of core body 10 may include a first lifting column top screw hole 12*c* and a second lifting column top screw hole 12*d*. First lifting column top screw hole 12*c* may be configured to secure first lifting column 31*a* (FIG. 1D) to core body 10. Second lifting column top screw hole 12*d* may be configured to secure second lifting column 32*a* (FIG. 1D) to core body 10.

Figure 3C:
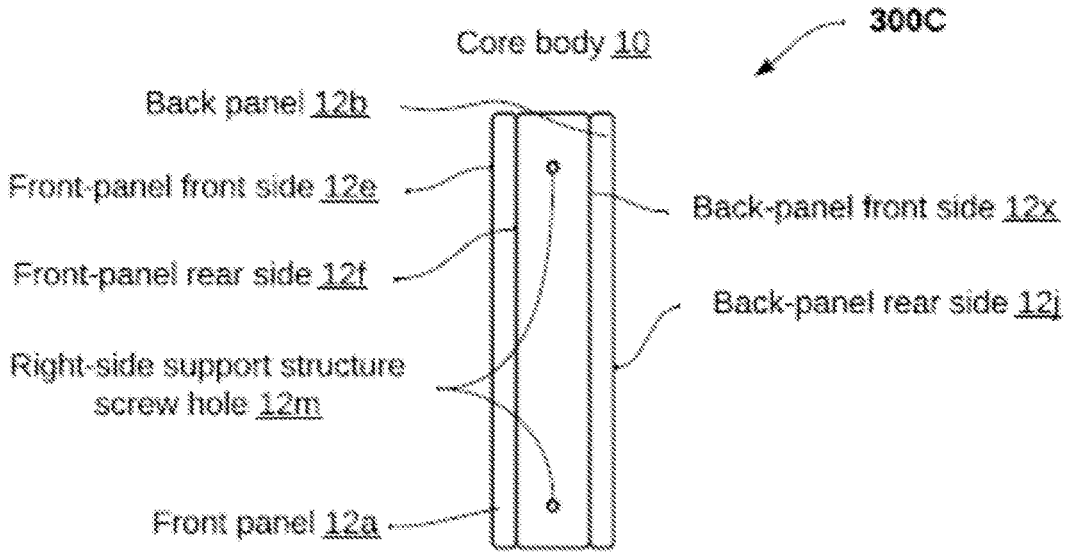
FIG. 3C shows a right-side view 300C of a core body, in accordance with one or more implementations.
Figure 3D:
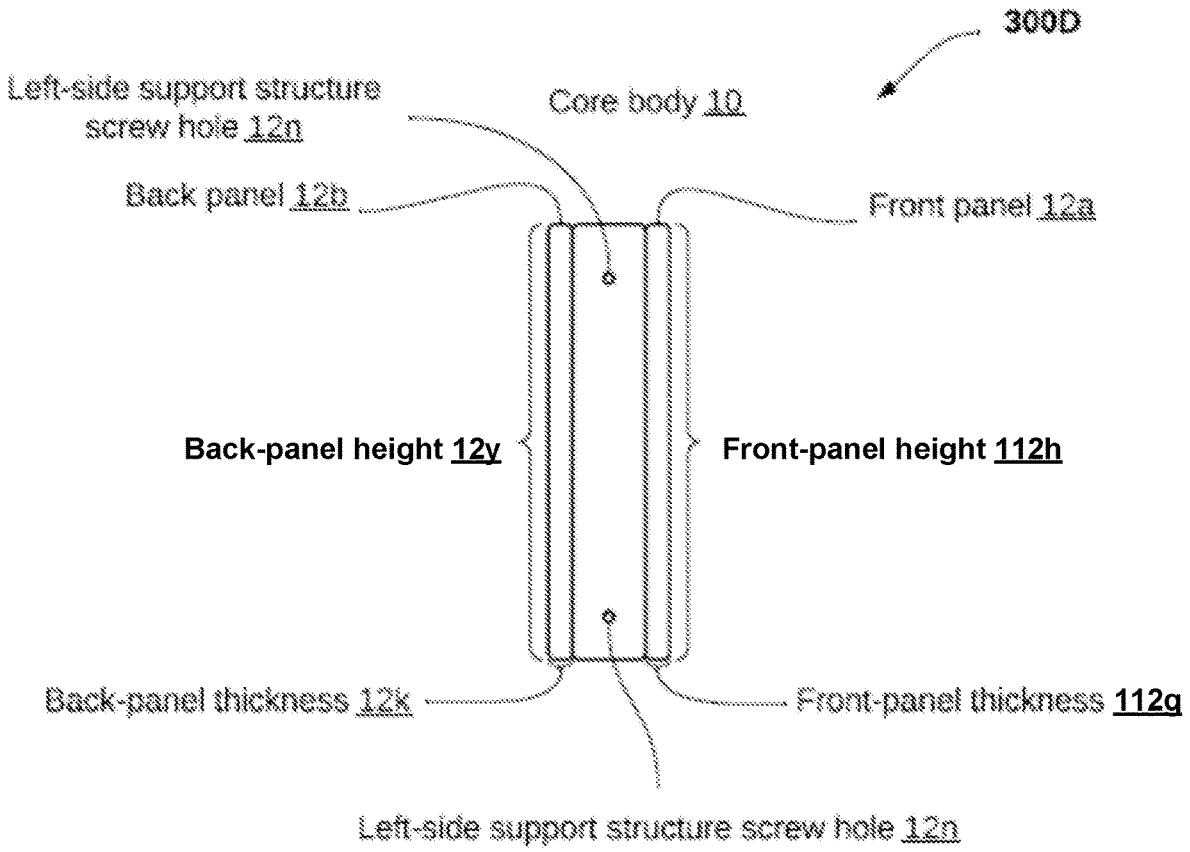
FIG. 3D shows a left-side view 300D of a core body, in accordance with one or more implementations.
Figure 4A:
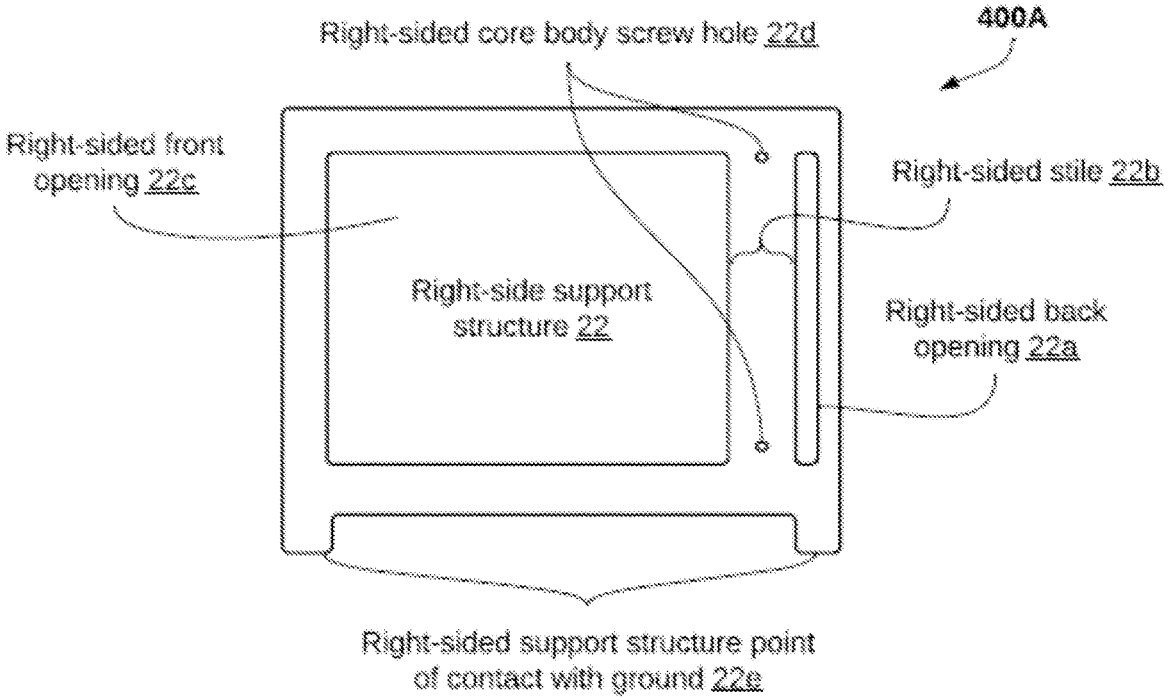
FIG. 4A shows an outside view 400A of a right-side support structure, in accordance with one or more implementations.

FIG. 3C shows a right-side view 300C of core body 10. FIG. 3D shows a left-side view 300D of core body 10. In some implementations, back panel 12*b* may include a back-panel front side 12*x* (FIG. 3C), and a back-panel rear side 12*j* (FIG. 3C). Back-panel front side 12*x* (FIG. 3C) of back panel 12*b* may be coupled to the rear of column housing frame 11 (FIG. 1E). Back panel 12*b* may be configured to provide support for core body 10 by being inserted into a left-sided back opening 24*a* (FIG. 4C) of left-side support structure 24 (FIG. 4C) and a right-sided back opening 22*a* (FIG. 4A) of right-side support structure 22 (FIG. 4A). In some implementations, back panel 12*b* may include a back-panel height 12*y* (FIG. 3D), and a back-panel thickness 12*k* (FIG. 3D).

In some implementations, front panel 12*a* may include a front-panel front side 12*e* (FIG. 3C) and a front-panel rear side 12*f* (FIG. 3C). Front-panel rear side 12*f* (FIG. 3C) of front panel 12*a* may be coupled to the front of housing frame 11 (FIG. 1E). Front panel 12*a* may be configured to provide support for core body 10 by being inserted into a left-sided front opening 24*c* (FIG. 4C) of left-side support structure 24 (FIG. 4C) and a right-sided front opening 22*c* (FIG. 4A) of right-side support structure 22 (FIG. 4A). In some implementations, front panel 12*a* may include a front-panel height 112*h* (FIG. 3D) and a front-panel thickness 112*g* (FIG. 3D).

Figure 3E:
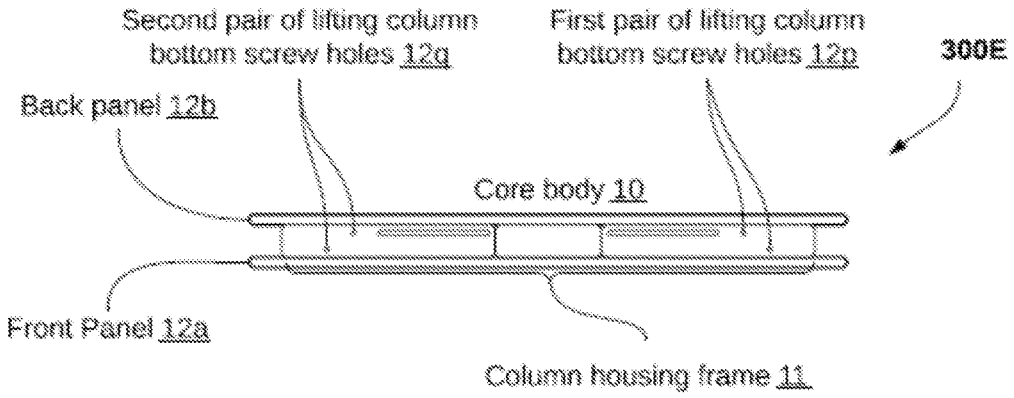
FIG. 3E shows a bottom view 300E of a core body, in accordance with one or more implementations.
Figure 3F:
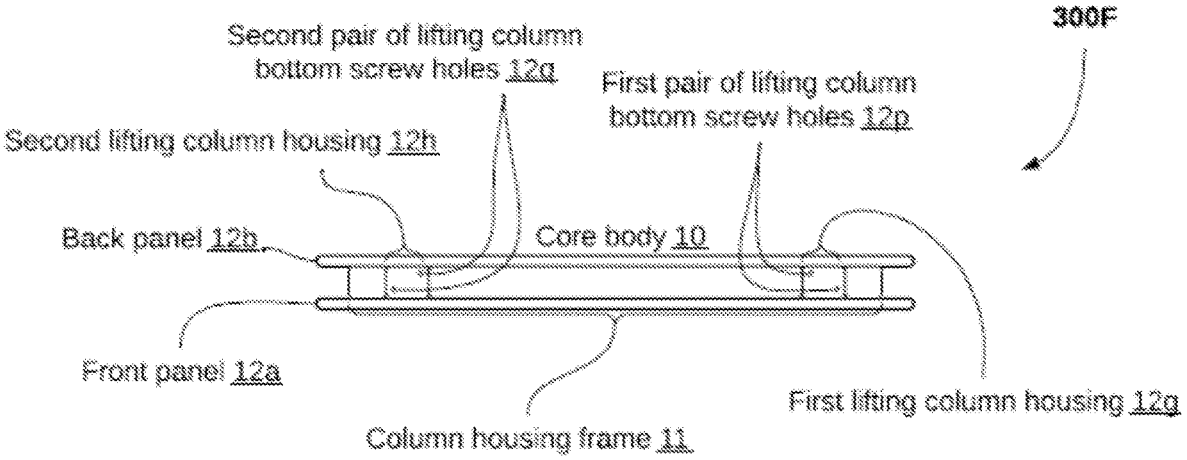
FIG. 3F shows a top view 300F of a core body, in accordance with one or more implementations.

FIG. 3E shows a bottom view 300E of core body 10, including a first pair of lifting column bottom screw holes 12*p*, a second pair of lifting column bottom screw holes 12*q*, and/or other components. First pair of lifting column bottom screw holes 12*p* may be configured to include one or more screws, nuts, bolts, pins, and/or one or more other fastening hardware or fasteners to secure/fasten first lifting column 31*a* (FIG. 1D) of first lifting mechanism 31 (FIG. 1D) to first lifting column housing 12*g* (FIG. 1E) of core body 10. Second pair of lifting column screw holes 12*q* may be configured to include one or more of screws, nuts, bolts, pins, and/or one or more other fastening hardware or fasteners to secure/fasten second lifting column 32*a* (FIG. 1D) of second lifting mechanism 32 (FIG. 1D) to second lifting column housing 12*h* (FIG. 1E) of core body 10.

In some implementations, first lifting mechanism 31 may be coupled to core body 10 by first lifting column 31*a* (FIG. 1D) being inserted into first lifting column housing 12*g* (FIG. 1E). In some implementations, second lifting mechanism 32 may be coupled to core body 10 by second lifting column 32*a* (FIG. 1D) being inserted into second lifting column housing 12*h* (FIG. 1E).

Figure 4B:
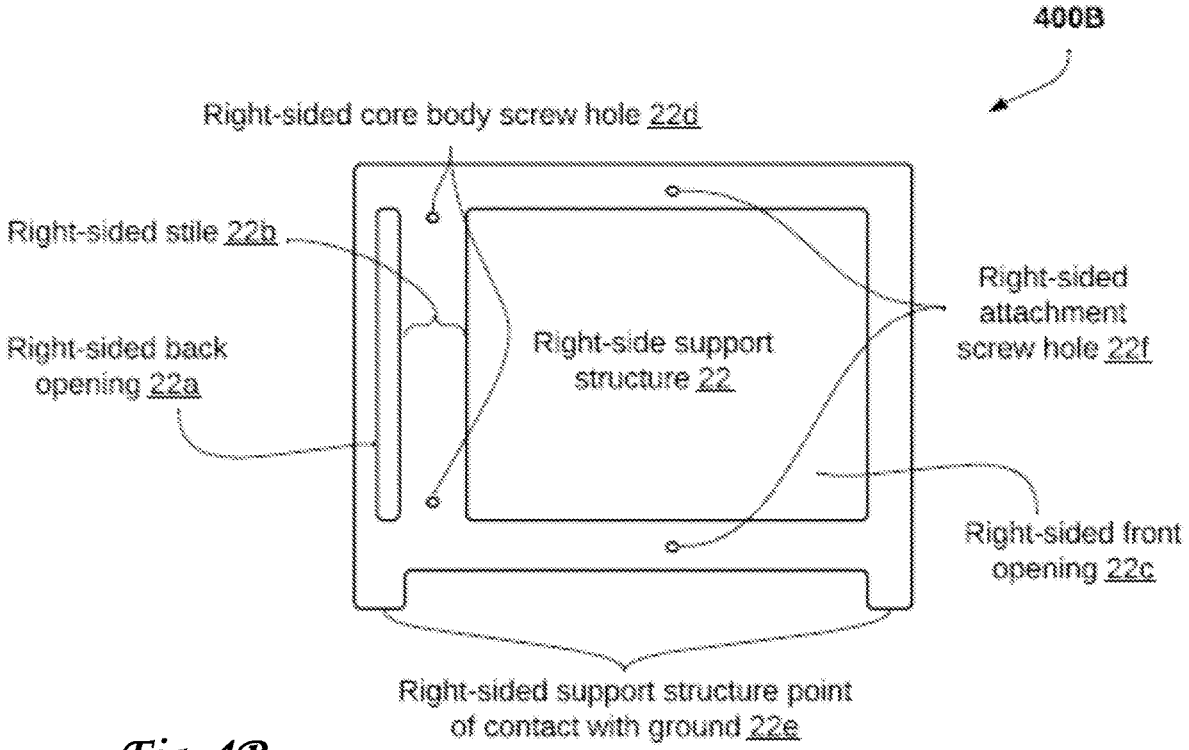
FIG. 4B shows an inside view 400B of a right-side support structure, in accordance with one or more implementations.
Figure 4C:
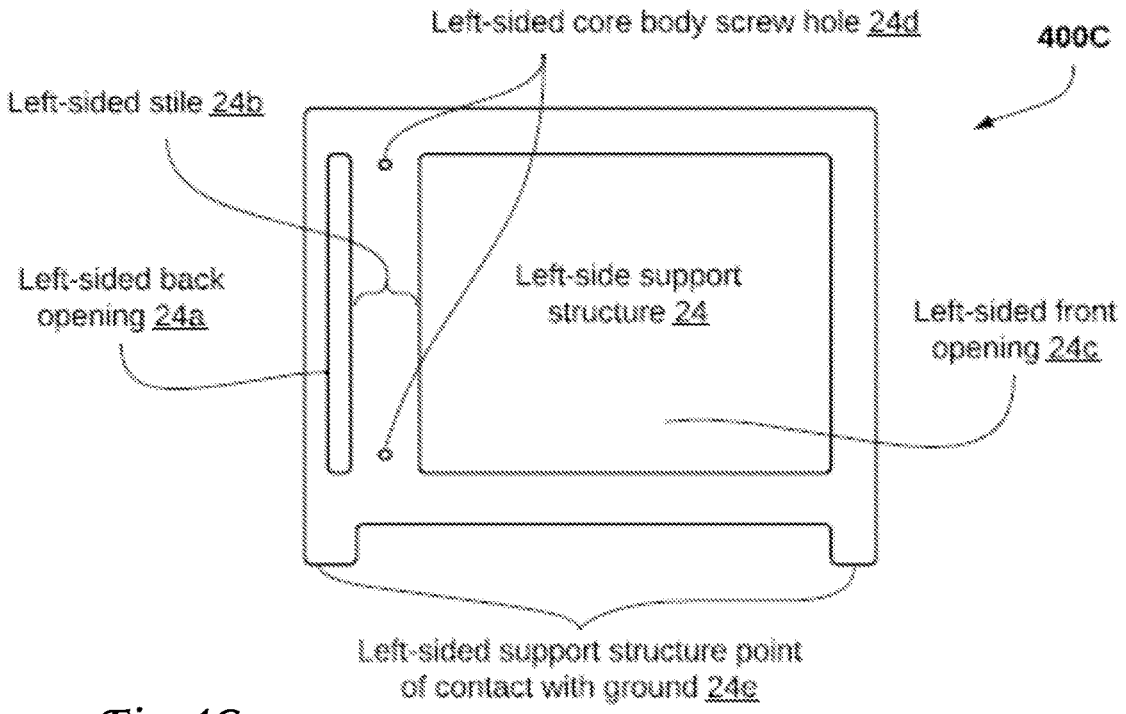
FIG. 4C shows an outside view 400C of a left-side support structure, in accordance with one or more implementations.

By way of non-limiting example, both views 300E and 300F show a length of front panel 12*a* and a length of back panel 12*b*, each of which may be greater than a length of column housing frame 11. In some implementations, the extra length of the front panel 12*a* may be configured to be inserted into right-sided front opening 22*c* (FIG. 4A) and left-sided front opening 24*c* (FIG. 4C). In some implementations, as shown in FIG. 1B, inserting front panel 12*a* into right-sided front opening 22*c* and left-sided front opening 24*c* leaves almost the entirety of right-sided front opening 22*c* and left-sided front opening 24*c* available (minus front-panel thickness 112*g*), e.g., for one or more modular attachments (such as, by way of non-limiting example, modular attachment 15 as depicted in FIG. 6). In some implementations, the extra length of the back panel 12*b* may be configured to be inserted into right-sided back opening 22*a* (FIG. 4A) and left-sided back opening 24*a* (FIG. 4C).

Referring to FIG. 1D, first lifting mechanism 31 may include one or more of first motor 31*c*, a first telescoping arm 31*b*, first lifting column 31*a*, and/or other components. In some implementations, first lifting mechanism 31 may have at least two stages. Second lifting mechanism 32 may include one or more of second motor 32*c*, a second telescoping arm 32*b*, second lifting column 32*a*, and/or other components. In some implementations, second lifting mechanism 32 may have at least two stages. In some implementations, first and second telescoping arms (31*b*, 32*b*) are the only visibly moving parts of the entire desk when the desk is being lifted and/or lowered (during use, after assembly). In some implementations, first lifting mechanism 31 may include a first mechanical linear actuator. Second lifting mechanism 32 may include a second mechanical linear actuator. Controlling first and second lifting mechanisms (31, 32) may include controlling the first mechanical linear actuator and the second mechanical linear actuator in synchrony.

Figure 4D:
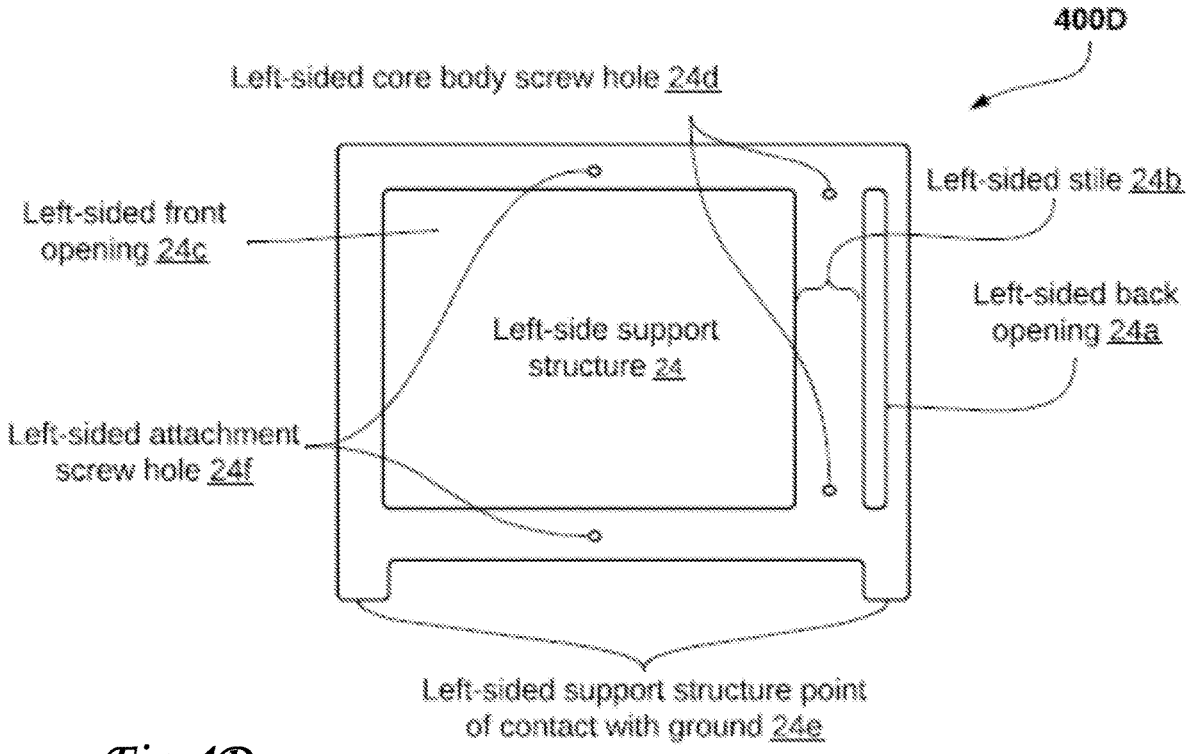
FIG. 4D shows an inside view 400D of a left-side support structure, in accordance with one or more implementations.

Referring to FIG. 1A, left-side support structure 24 may be disposed at a left side of desk 100 with respect to work surface 3 of working body 2. In some implementations, left-side support structure 24 may be stationary during adjustments of the current height of work surface 3. FIG. 4D shows an inside view 400D of left-side support structure 24. FIG. 4C shows an outside view 400C of left-side support structure 24. In some implementations, left-side support structure 24 may include left-sided back opening 24*a* and left-sided front opening 24*c* in front of left-sided back opening 24*a*.

Left-sided back opening 24*a* of left-side support structure 24 may be configured to include a first width at least as wide as back-panel thickness 12*k* (FIG. 3D) and a first height at least as long as back-panel height 12*y* (FIG. 3D). In some implementations, left-side support structure 24 may be configured to include a left-sided stile 24*b*, disposed between left-sided back opening 24*a* and left-sided front opening 24*c*. Left-sided stile 24*b* may be configured to have a width less than a distance between back-panel front side 12*x* (FIG. 3C) and front-panel rear side 12*f* (FIG. 3C). By way of non-limiting example, left-sided stile 24*b* of left side support structure 24 may be identified as one or more of a left-sided post, a left-sided connector, a left-sided closing, a left-sided panel, a left-sided member, and/or other terms that properly identify 24*b*.

In some implementations, left-side support structure 24 may be configured to include left-sided front opening 24*c* comprised of a width and a height. In some implementations, the width of left-sided front opening 24*c* may be in the range of 80%-95% of a width of left-side support structure 24. In some implementations, the width of left-sided front opening 24*c* may be in the range of 70%-85% of a width of left-side support structure 24. In some implementations, the width of left-sided front opening 24*c* may be in the range of 60%-80% of a width of left-side support structure 24, as depicted in FIG. 4A. In some implementations, the height of left-sided front opening 24*c* may be in the range of 80%-95% of a height of left-side support structure 24. In some implementations, the height of left-sided front opening 24*c* may be in the range of 70%-85% of a height of left-side support structure 24. In some implementations, the height of left-sided front opening 24*c* may be in the range of 60%-80% of a height of left-side support structure 24, as depicted in FIG. 4A. In some implementations, the width of left-sided front opening 24*c* may range between 14 and 17 inches, or between 15 and 20 inches. For example, the width of left-sided front opening 24*c* may be about 15 inches. In some implementations, the height of left-sided front opening 24*c* may range between 18 and 23 inches, or between 20 and 25 inches. For example, the height of left-sided front opening 24*c* may be about 21 inches.

In some implementations, a shape of left-side support structure 24 as viewed from the left side of desk 100 may be a rectangular shape. By way of non-limiting illustration, the shape of left-side support structure 24 as viewed from the left side of desk 100 may be one or more of a circle, triangle, and/or other geometric shapes. It is noted that a difference in the shape of the left-side support structure as viewed from the left side may change many other components of desk 100. In implementations where a side support structure would have a different shape than depicted, the same manner of coupling components together would be retained so that working body 2 would be lifted and/or lowered by lifting mechanisms positioned at its rear and having support structures on the side of desk 100.

Referring to FIG. 6, right-sided front opening 22*c* may be configured to support one or more modular attachments, including but not limited to modular attachment 15, which may be, e.g., a storage unit or a waste bin holder (with two shelves near the top). For example, as shown, a side of modular attachment 15 may be supported by (the inside of) a bottom portion of right-side support structure 22 at or near the bottom of right-sided front opening 22*c*. For example, as shown, part of modular attachment 15 may be inserted into right-sided front opening 22*c* and may rest on (the inside of) the bottom portion of right-side support structure 22 at or near the bottom of left-sided front opening 22*c*. In some implementations, right-side support structure 22 may have a thickness between about 0.5 inch and 1 inch, or between 1 and 2 inches, to provide this support. In some implementations, one or more mounting brackets 16 may be configured to mechanically couple modular attachment 15 to either left-side support structure 24 (not depicted) or right-side support structure 22 (as shown in FIG. 6, e.g., by using one or both of attachment screw holes 22*f* shown in FIG. 4B). For example, the top attachment screw hole 22*f* may be used to mechanically couple the top left side of modular attachment 15 to right-side support structure 22 (by using a mounting bracket 16 in the orientation depicted in FIG. 10A), and the bottom attachment screw hole 22*f* may be used to mechanically couple the bottom left side of modular attachment 15 to right-side support structure 22 (by using a mounting bracket 16 in the orientation depicted in FIG. 10B). Note that the attachment screw hole (and/or the attachment to the support structure) is on the opposite side as the placement of modular attachment 15. For example, and as depicted in FIG. 6, modular attachment 15 is placed on the outside of right-side support structure 22 and the one or more mounting brackets 16 are attached to the inside of right-side support structure 22.

FIG. 6 depicts modular attachment 15 as being coupled on the outside of right-side support structure 22. However, this is exemplary and not intended to be limiting. In some implementations, modular attachment 15 may be coupled on the inside of right-side support structure 22. In other implementations, modular attachment 15 may be coupled on the outside of left-side support structure 24 (e.g., by using one or both of left-side attachment screw holes 24*f*). In other implementations, modular attachment 15 may be coupled on the inside of left-side support structure 24. FIG. 6 further depicts partition 19 coupled to work surface 3.

Figure 7:
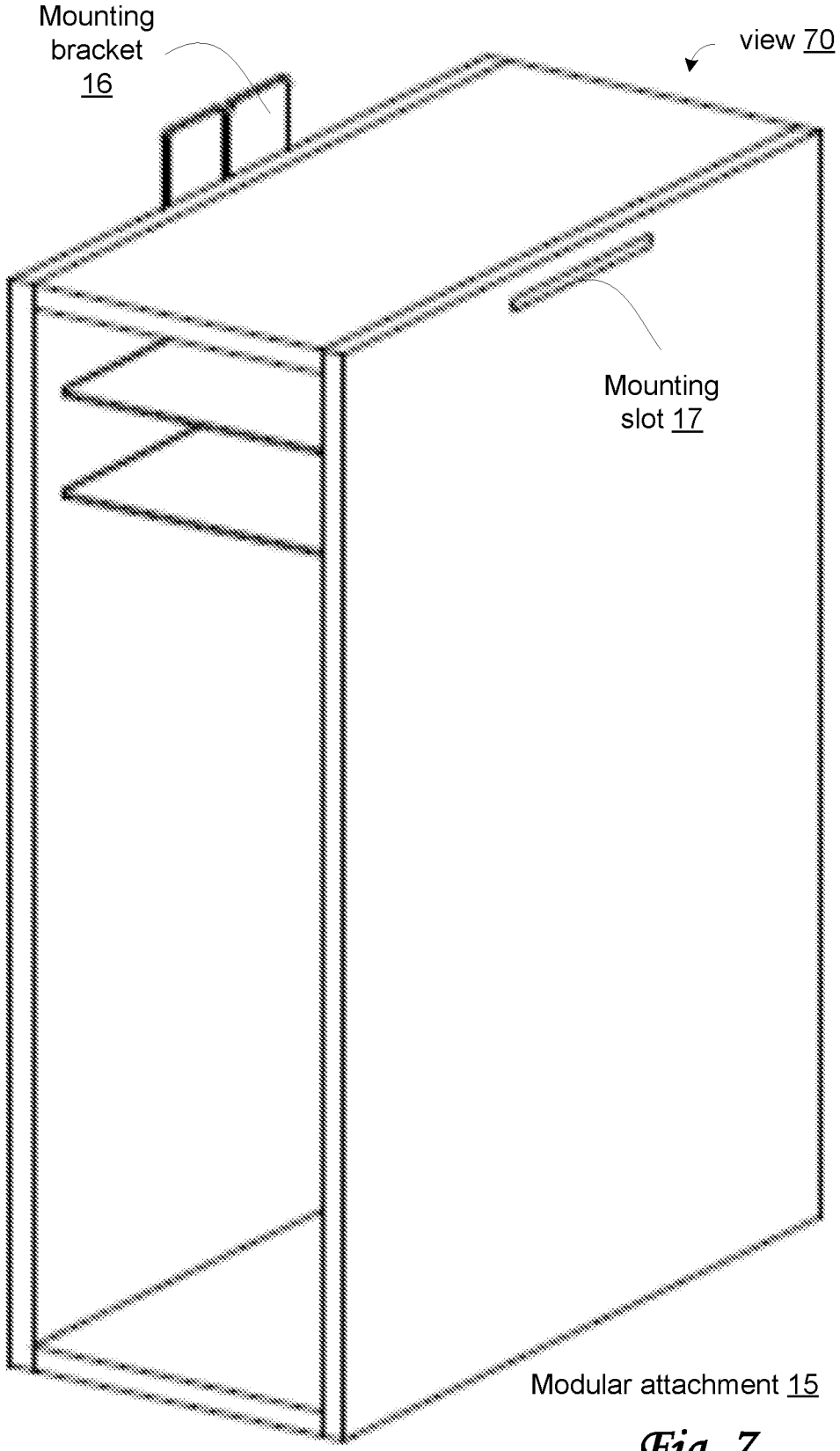
FIG. 7 shows a view of a modular attachment configured to be attached to a desk, in accordance with one or more implementations.
Figure 10A:
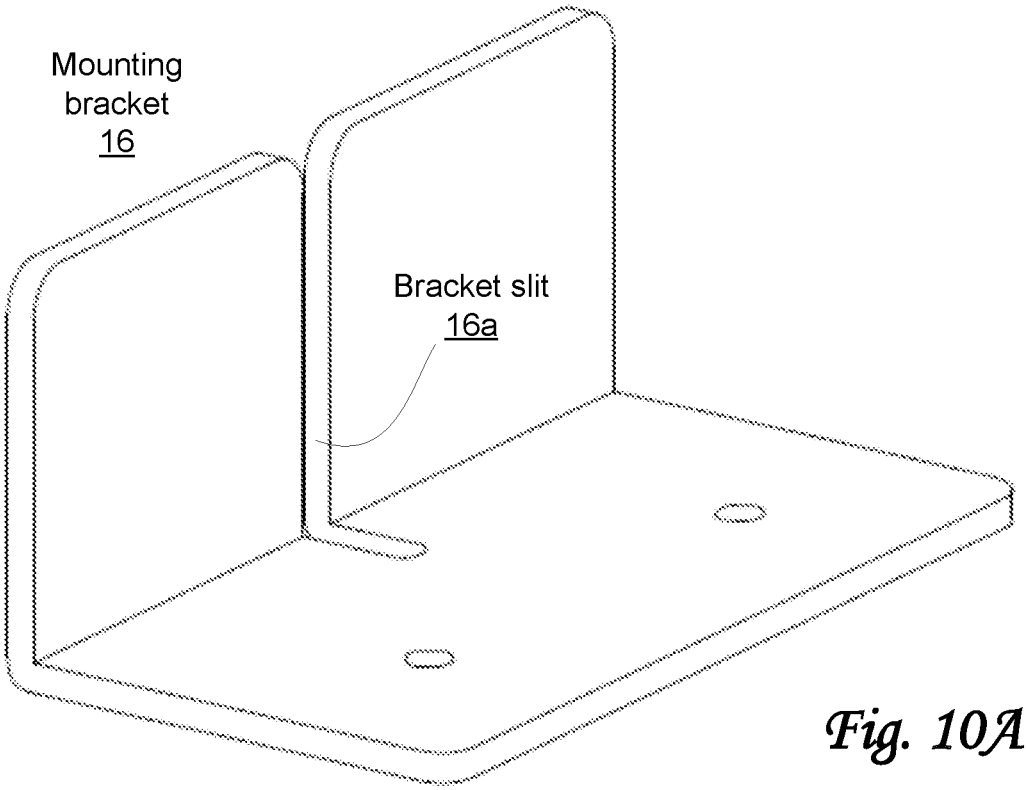
FIG. 10A-10B show mounting brackets for use with a desk with support structures configured to attach modular attachments, in accordance with one or more implementations.
Figure 10B:
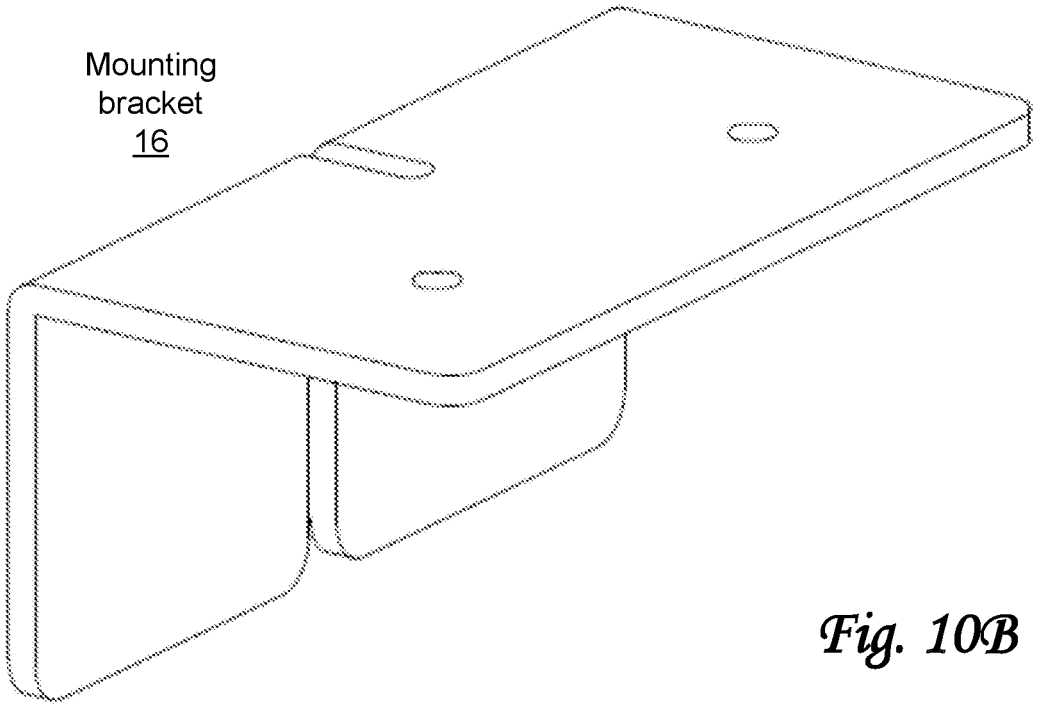

FIG. 7 shows a view 70 of modular attachment 15, including a mounting slot 17, one or more mounting brackets 16, and/or other components. By way of non-limiting example, mounting slot 17 may be configured such that a mounting bracket 16 can be inserted into mountain slot 17 and mechanically coupled to modular attachment 15. Modular attachment 15 may include a second mounting slot (not visible in view 70) on the left side of modular attachment 15 that is used to mechanically couple mounting bracket 16 to modular attachment 15. Additionally, mounting bracket 16 may be configured to mechanically couple to one of the support structures. For example, FIG. 10A shows mounting bracket 16, including a bracket slit 16*a*. In some implementations, mounting bracket 16 may be mechanically coupled to one of the support structures by connecting a fastener through bracket slit 16*a*, such as, e.g., a screw or bolt. As depicted in FIG. 10A, mounting bracket 16 may be an L-shaped bracket, and/or a right-angle bracket. In some implementations, bracket slit 16*a* may be in the center of at least one of the two angled portions of mounting bracket 16. As depicted, bracket slit 16*a* may be opened on one side (the top side in the orientation of FIG. 10A). FIG. 10B shows the same mounting bracket 16 as FIG. 10A, but in a reversed orientation.

Figure 8:
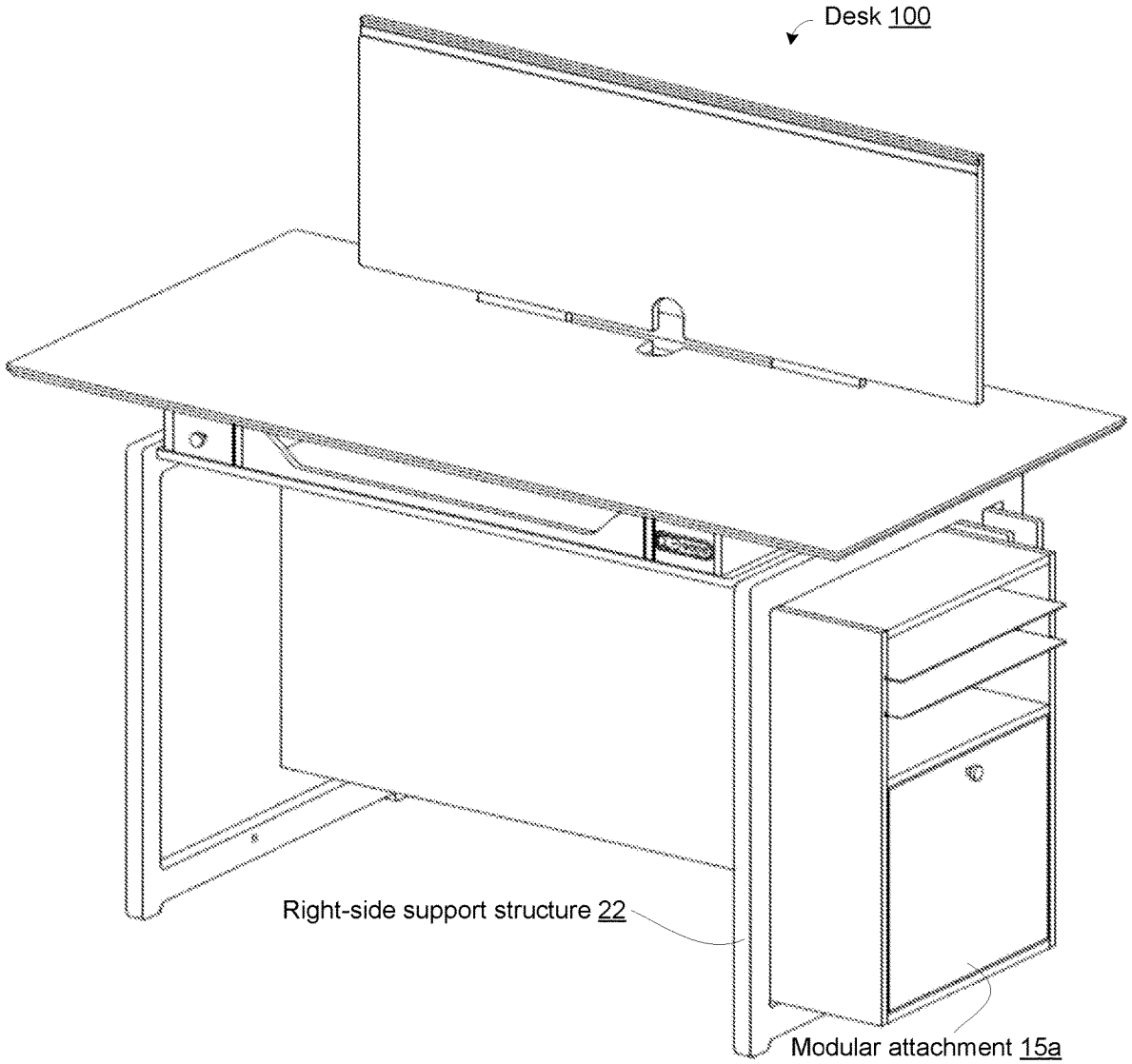
FIG. 8 shows an assembled view of a desk with support structures configured to attach modular attachments, in accordance with one or more implementations.
Figure 9:
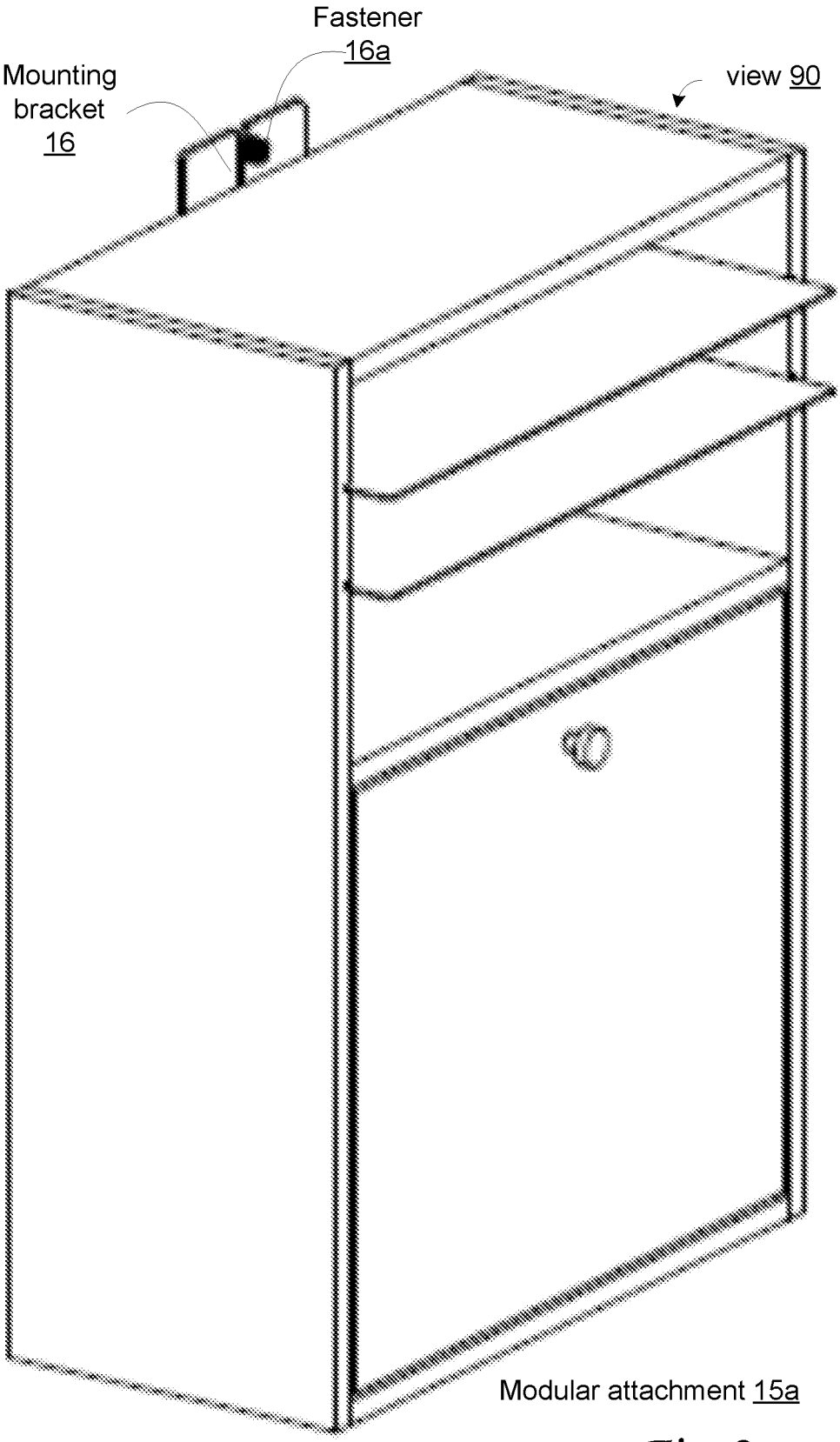
FIG. 9 shows a view of a modular attachment configured to be attached to a desk, in accordance with one or more implementations.

FIG. 8 depicts a different modular attachment than shown in FIG. 6 (here, desk 100 in FIG. 8 includes modular attachment 15*a*, which may be both a storage unit and a shelving unit combined) as being coupled on the outside of right-side support structure 22, in a similar manner as the coupling described for FIG. 6 (i.e., using one or more mounting brackets to mechanically couple modular attachment 15*a* to right-side support structure 22). FIG. 9 shows a view 90 of modular attachment 15*a*, including a mounting bracket 16, fastener 16*a*, and/or other components. FIG. 8 depicts modular attachment 15*a* as being coupled on the outside of right-side support structure 22. However, this is exemplary and not intended to be limiting. In some implementations, modular attachment 15*a* may be coupled on the inside of right-side support structure 22. In other implementations, modular attachment 15*a* may be coupled on the outside of left-side support structure 24 (e.g., by using one or both of left-side attachment screw holes 24*f*). In other implementations, modular attachment 15*a* may be coupled on the inside of left-side support structure 24.

Referring to FIG. 1A, right-side support structure 22 may be disposed at a right side of desk 100 with respect to work surface 3 of working body 2. In some implementations, right-side support structure 22 may be stationary during adjustments of the current height of work surface 3. FIG. 4A shows an outside view 400A of right-side support structure 22. FIG. 4B shows an inside view 400B of right-side support structure 22. In some implementations right-side support structure 22 may include right-sided back opening 22*a* and right-sided front opening 22*c* in front of right-sided back opening 22*a*.

Right-sided back opening 22*a* of right-side support structure 22 may be configured to include a first width at least as wide as a back-panel thickness 12*k* (FIG. 3D) and a first height at least as long as a back-panel height 12*y* (FIG. 3D). In some implementations, right-side support structure 22 may be configured to include a right-sided stile 22*b*, disposed between right-sided back opening 22*a* and right-sided front opening 22*c*. Right-sided stile 22*b* may be configured to have a width less than a distance between back-panel front side 12*x* (FIG. 3C) and front-panel rear side 12*f* (FIG. 3C). By way of non-limiting example, right-sided stile 22*b* of right-side support structure 22 may be identified as one or more of a right-sided post, a right-sided connector, a right-sided closing, a right-sided panel, a right-sided member, and/or other terms that properly identify 22*b*.

In some implementations, right-side support structure 22 may be configured to include right-sided front opening 22*c* comprised of a width and a height. The width of right-sided front opening 22*c* may be in the range of 80%-95% of a width of right-side support structure 22. In some implementations, the width of right-sided front opening 22*c* may be in the range of 70%-85% of a width of right-side support structure 22. In some implementations, the width of right-sided front opening 22*c* may be in the range of 60%-80% of a width of right-side support structure 22, as depicted in FIG. 4C. In some implementations, the height of right-sided front opening 22*c* may be in the range of 80%-95% of a height of right-side support structure 22. In some implementations, the height of right-sided front opening 22*c* may be in the range of 70%-85% of a height of right-side support structure 22. In some implementations, the height of right-sided front opening 22*c* may be in the range of 60%-80% of a height of right-side support structure 22, as depicted in FIG. 4C. In some implementations, the width of right-sided front opening 22*c* may range between 14 and 17 inches, or between 15 and 20 inches. For example, the width of right-sided front opening 22*c* may be about 15 inches. In some implementations, the height of right-sided front opening 2*sc* may range between 18 and 23 inches, or between 20 and 25 inches. For example, the height of right-sided front opening 2*sc* may be about 21 inches.

In some implementations, a shape of the right-side support structure 22 as viewed from the right side of desk 100 may be a rectangular shape. By way of non-limiting illustration, the shape of the right-side support structure 22 as viewed from the right side of desk 100 may be one or more of a circle, triangle, and/or other geometric shapes. It is noted that a difference in the shape of the right-side support structure as viewed from the right side may change many other components of desk 100. In implementations where a side support structure would have a different shape than depicted, the same manner of coupling components together would be retained so that working body 2 would be lifted and/or lowered by lifting mechanisms positioned at its rear and having support structures on the side of desk 100.

In some implementations, right-side support structure 22 and left-side support structure 24 may have attachment screw holes as shown by 22*f* (FIG. 4B, 400B) and 24*f* (FIG. 4D, 400D) configured to support the coupling of interchangeable modular desk attachments. By way of non-limiting example, the modular attachments may be one or more of extra storage, shelves, waste receptacles, file organizers, water coolers, plant holders, desk extension platforms, pet bed attachment, pet entertainment attachment, and/or other functional attachments (as well as combinations thereof) to further customize the desk to satisfy a user's desires (and/or the pet's desires).

In some implementations, right-side support structure 22 and left-side support structure 24 may fully support working body 2 and core body 10. In some implementations, each support structure may have one point of contact with the ground. In some implementations, each support structure may have at least two points of contact with the ground. By way of non-limiting example, there may be one or more left-sided support structure points of contact with ground 24*e* (FIG. 4C). Similarly, there may be one or more right-sided support structure points of contact with ground 22*e* (FIG. 4A). In some implementations, by virtue of left-side support structure 22 and right-side support structure 24 fully supporting working body 2 and core body 10, working body 2 and core body 10 do not contact the ground directly.

Figure 5A:
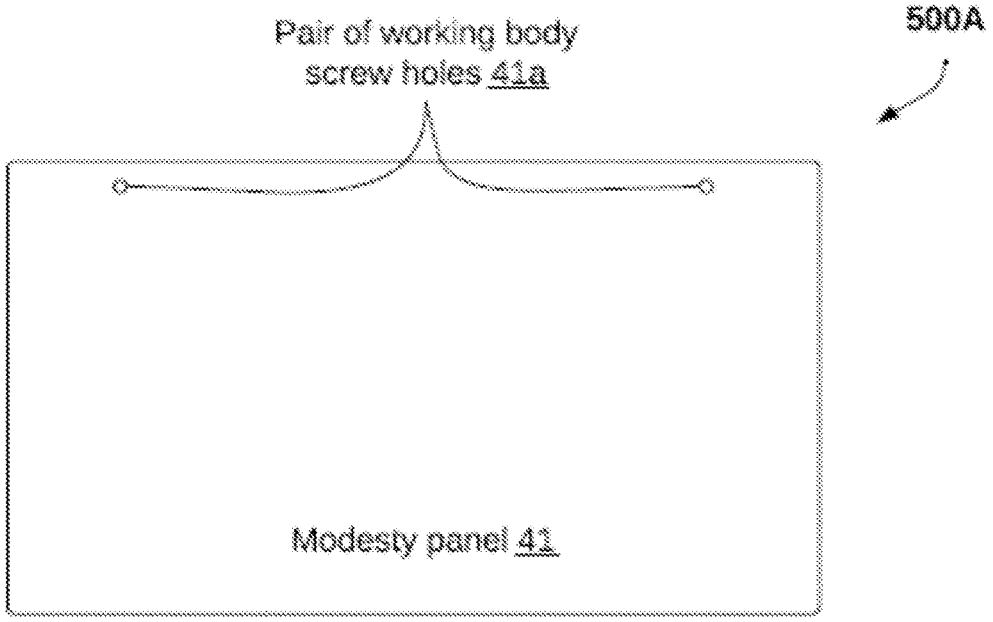
FIG. 5A shows a front view 500A of a modesty panel, in accordance with one or more implementations.
Figure 5B:
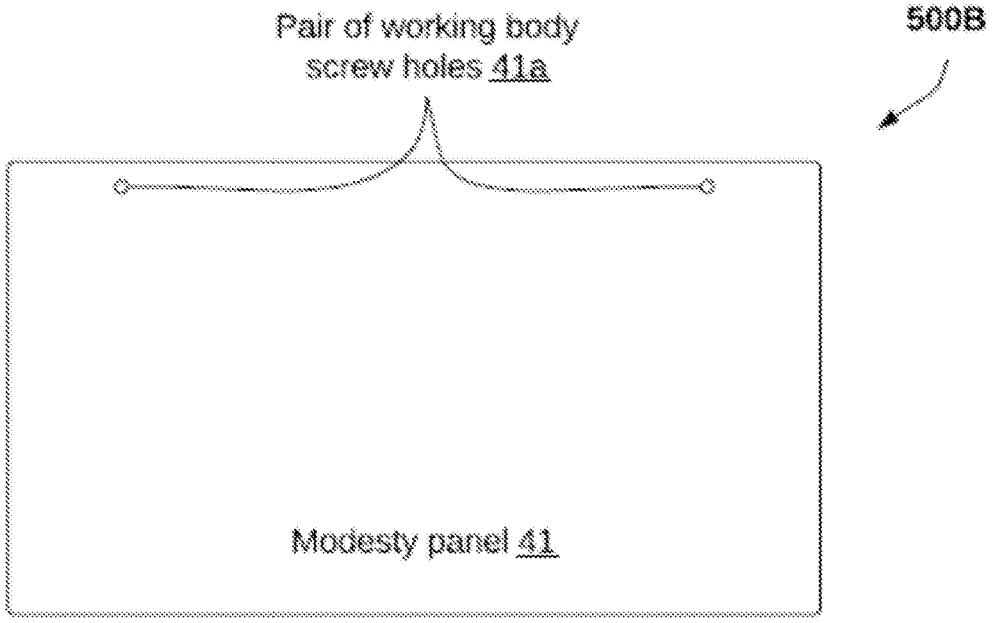
FIG. 5B shows a rear view 500B of a modesty panel, in accordance with one or more implementations.

FIG. 5A shows a front view 500A of a modesty panel 41. FIG. 5B shows a rear view 500B of modesty panel 41. In some implementations, modesty panel 41 may include a pair working body screw holes 41*a*, and/or other components. Pair of working body screw holes 41*a* may facilitate convenient coupling of modesty panel 41 to working body 2 by virtue of one or more screws, nuts, bolts, pins, and/or one or more other fastening hardware or fasteners to secure/fasten objects together. Modesty panel 41 may be configured to move with working body 2 as it is lifted and/or lowered.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A desk with support structures configured to attach modular attachments, the desk having a front side, a back side, a left side, and a right side as viewed by a user, wherein the desk comprises:

a work surface of the desk, wherein the work surface is disposed at a current height;

a left-side support structure disposed at the left side of the desk with respect to the work surface of the desk, wherein the left-side support structure supports at least part of the desk, wherein the left-side support structure includes a left-sided front opening and a left-sided back opening, wherein the left-sided front opening is closer to the front side of the desk than to the back side of the desk, and wherein the left-sided back opening is closer to the back side of the desk than to the front side of the desk;

a right-side support structure disposed at the right side of the desk with respect to the work surface of the desk, wherein the right-side support structure supports at least part of the desk, wherein the right-side support structure includes a right-sided front opening and a right-sided back opening, wherein the right-sided front opening is closer to the front side of the desk than to the back side of the desk, and wherein the right-sided back opening is closer to the back side of the desk than to the front side of the desk;

a core body disposed vertically at a rear side of the desk with respect to the work surface of the desk, wherein the core body extends laterally between the left side and the right side of the desk, wherein the core body is coupled to the left-side support structure and coupled to the right-side support structure;

a working body that provides the work surface of the desk, wherein the working body is configured to be supported by the core body at the rear side of the desk;

a modular attachment for the desk; and one or more mounting brackets configured to mechanically couple the modular attachment to either the left-side support structure or the right-side support structure such that a side of the modular attachment is disposed in either the left-sided front opening or the right-sided front opening, and further such that the modular attachment is supported by either the left-side support structure or the right-side support structure, respectively.

2. The desk of claim 1, wherein the modular attachment and the one or more mounting brackets are configured to mechanically couple the modular attachment either between the left-side support structure and the right-side support structure, or outside both the left-side support structure and the right-side support structure.

3. The desk of claim 1, wherein the width of the left-sided front opening ranges between 14 and 17 inches, wherein the height of the left-sided front opening ranges between 18 and 23 inches, wherein the width of the right-sided front opening ranges between 14 and 17 inches, and wherein the height of the right-sided front opening ranges between 18 and 23 inches.

4. The desk of claim 1, wherein the modular attachment for the desk includes one or more of a storage unit, a waste bin holder, and a PC holder.

5. The desk of claim 1, wherein the left-side support structure further includes a left stile disposed between the left-sided back opening and the left-sided front opening, wherein the right-side support structure further includes a right stile disposed between the right-sided back opening and the right-sided front opening.

6. The desk of claim 1, wherein the current height at which the work surface is disposed is adjustable, wherein the left-side support structure is stationary during adjustments of the current height of the work surface, wherein the right-side support structure is stationary during the adjustments of the current height of the work surface, wherein the core body houses a first lifting mechanism and a second lifting mechanism, wherein the core body is stationary during the adjustments of the current height of the work surface except for the first and second lifting mechanism, wherein the working body is configured to adjustably couple to the first and second lifting mechanisms, wherein the desk further comprises:

a control interface configured to receive user input from the user; and control circuitry configured to:

(i) detect the user input received by the control interface;

(ii) responsive to detection of the user input, control the first and second lifting mechanisms to either (a) lift the working body and increase the current height of the work surface, or (b) lower the working body and decrease the current height of the work surface.

7. The desk of claim 6, wherein the first lifting mechanism includes a first mechanical linear actuator, wherein the second lifting mechanism includes a second mechanical linear actuator, and wherein controlling the first and second lifting mechanisms includes controlling the first mechanical linear actuator and the second mechanical linear actuator in synchrony.

8. The desk of claim 7, wherein the first lifting mechanism further includes a first motor, wherein the second lifting mechanism further includes a second motor, wherein the working body includes a first housing configured to house the first motor, and wherein the working body includes a second housing configured to house the second motor.

9. The desk of claim 8, wherein the first lifting mechanism further includes a first lifting column and a first telescoping arm, wherein the first lifting mechanism has at least two stages, and wherein the second lifting mechanism further includes a second lifting column and a second telescoping arm, wherein the second lifting mechanism has at least two stages.

10. The desk of claim 1, wherein the left-side support structure and the right-side support structure fully support the working body and the core body, wherein each support structure has at least 2 points of contact with the ground, wherein the working body and the core body do not contact the ground directly.

11. The desk of claim 1, wherein the work surface of the working body has a surface area ranging from 46-52 inches in width and about 26 inches deep.

12. The desk of claim 1, wherein the left-sided front opening of the left-side support structure further includes a width and a height, wherein the width of the left-sided front opening ranges between 60% and 80% of a width of the left-side support structure, wherein the height of the left-sided front opening ranges between 60% and 80% of a height of the left-side support structure, wherein the right-sided front opening of the right-side support structure further includes a width and a height, wherein the width of the right-sided front opening ranges between 60% and 80% of the width of the right-side support structure, and wherein the height of the right-sided front opening ranges between 60% and 80% of the height of the right-side support structure.

* * * * *